US007515861B2

(12) United States Patent
Fukatsu et al.

(10) Patent No.: US 7,515,861 B2
(45) Date of Patent: Apr. 7, 2009

(54) IMAGE HEATING APPARATUS CONTROLLING RELATIVE POSITIONS OF FIXING BELT AND RECORDING MATERIAL

(75) Inventors: Makoto Fukatsu, Mishima (JP); Yasunori Chigono, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 141 days.

(21) Appl. No.: 11/530,806

(22) Filed: Sep. 11, 2006

(65) Prior Publication Data

US 2007/0059066 A1 Mar. 15, 2007

(30) Foreign Application Priority Data

Sep. 13, 2005 (JP) ..... 2005-265516

(51) Int. Cl.
*G03G 15/20* (2006.01)

(52) U.S. Cl. ..... 399/341

(58) Field of Classification Search ..... 399/341, 399/320, 328, 329, 407
See application file for complete search history.

(56) References Cited

U.S. PATENT DOCUMENTS 5,235,393 A * 8/1993 Merle ..... 399/341
7,035,578 B1 * 4/2006 Young ..... 399/322

FOREIGN PATENT DOCUMENTS

| | | |
|---|---|---|
| JP | 64-035452 | 2/1989 |
| JP | 4-216580 | 8/1992 |
| JP | 4-362679 | 12/1992 |
| JP | 5-216322 | 8/1993 |
| JP | 6-230687 | 8/1994 |
| JP | 2001-083834 | 3/2001 |
| JP | 2003-084477 | 3/2003 |
| JP | 2003084596 A * | 3/2003 |
| JP | 2003-131524 | 5/2003 |
| JP | 2004-109860 | 4/2004 |

* cited by examiner

*Primary Examiner*—Quana M Grainger
(74) *Attorney, Agent, or Firm*—Canon USA Inc IP Div

(57) ABSTRACT

An image heating apparatus that causes a recording material carrying a fixed toner image to be in close contact with a belt and improves gloss level of an image surface is provided. A decrease in the separability of the recording material from the belt can be suppressed by control of the position on the belt in close contact with the leading edge of the recording material.

4 Claims, 27 Drawing Sheets

IMAGE HEATING APPARATUS CONTROLLING RELATIVE POSITIONS OF FIXING BELT AND RECORDING MATERIAL

BACKGROUND OF THE INVENTION

1. Field of the Invention

The present invention relates to an image heating apparatus that can be suitably used as a gloss application apparatus.

2. Description of the Related Art

Electrophotographic image forming apparatuses, such as copiers and printers, are widely known, and many full-color image forming apparatuses are commercially available, in addition to monochrome ones. As the increased use of electrophotographic image forming apparatuses in various fields, the level of requirements on image quality becomes increasingly higher. One determinant factor of image quality, in particular, the gloss level of a full-color image is smoothness of an output image.

A method for improving the smoothness of an output image by use of a recording material including a transparent thermoplastic resin layer is disclosed in Japanese Patent Laid-Open Nos. 64-035452, 5-216322, and 2003-084477.

Japanese Patent Laid-Open Nos. 4-216580, 4-362679, and 2004-109860 disclose a belt fuser configured to press and heat a recording material carrying an unfixed toner image by using a fixing belt including a heat-resistance film, solidify the toner image by cooling the recording material while the recording material is in close contact with the fixing belt, and then separate the recording material from the fixing belt.

When standard-sized recording materials are repeatedly used through such an image forming method, a phenomenon occurs in which foreign matter such as paper powder and a resin component drops from an end of a recording material and attaches to a surface of the fixing belt. The foreign matter may be transferred to an end of the subsequent recording material, causing image defects, and/or the accumulated foreign matter may damage the fixing belt, destroying the durability of the fixing belt.

In addition to the above problems, the inventor et al. finds that, if foreign matter such as paper powder and a resin component dropping from an end of a recording material is attached to and accumulated on the fixing belt, when the subsequent recording material is placed on the fixing belt such that the leading edge of the subsequent recording material overlaps the foreign matter, the separability of the recording material from a conveyance separation portion on the fixing belt significantly decreases.

A belt fuser discussed in Japanese Patent Laid-Open No. 2004-109860 uses a structure in which at least one of opposite side ends of a recording material separated from a fixing belt along the direction of conveyance of the recording material is cut and removed. Therefore, even if foreign matter such as paper powder and a resin component of a recording material attached to and accumulated on the fixing belt is then attached and transferred to an end of the subsequent recording material, the attached foreign matter does not affect an output image by cutting and removing a part of the recording material to which the foreign matter is attached.

However, no consideration is given to leading and trailing ends of the recording material, which are orthogonal to the direction of conveyance of the recording material.

SUMMARY OF THE INVENTION

The present invention is directed to an image heating apparatus capable of suppressing a decrease in the durability of a fixing belt.

The present invention is also directed to an image heating apparatus capable of suppressing a decrease in the separability of a recording material from a fixing belt.

According to an aspect of the present invention, an image heating apparatus operable to heat a toner image formed on a recording material includes an endless belt capable of being in contact with a surface of the recording material, the surface carrying the toner image; a heating member configured to heat the recording material; a cooling member configured to cool the recording material; and a controller configured to control relative positions of an outer peripheral surface of the belt and the recording material, the controller causing a subsequent recording material to be in close contact with an area substantially the same as an area in close contact with a previous recording material on the belt. The recording material carrying the toner image is heated by the heating member and cooled by the cooling member while being moved together with rotation of the belt with the surface carrying the toner image of the recording material being in close contact with the belt, and the recording material is then separated from the belt. The controller controls at least one of driving of the belt and conveyance of the recording material so that a position on the belt in contact with a leading edge of the subsequent recording material is shifted downstream of a position on the belt in contact with a leading edge of the previous recording material in a rotation direction of the belt at a predetermined timing.

Further features of the present invention will become apparent from the following description of exemplary embodiments with reference to the attached drawings.

DESCRIPTION OF THE EMBODIMENTS

First Exemplary Embodiment

Figure 2:
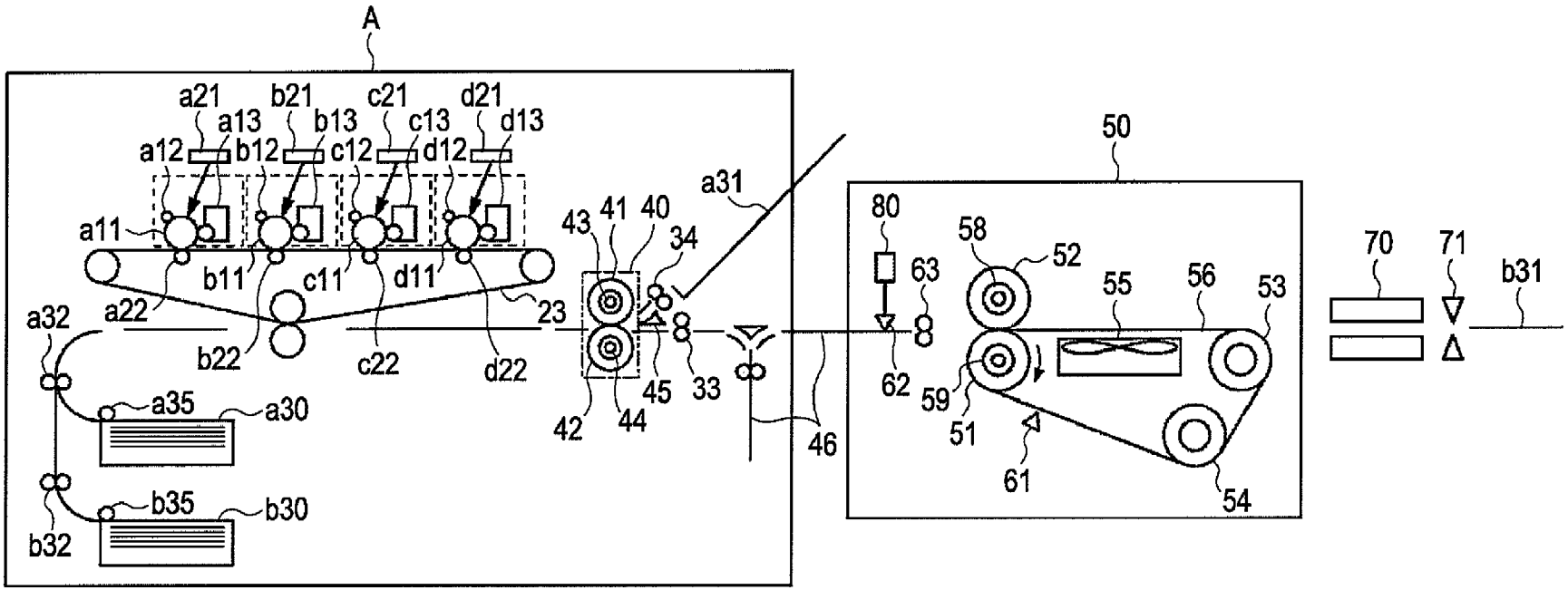
FIG. 2 is a schematic cross-sectional view of an image forming device incorporating the image heating apparatus.

FIG. 2 shows a schematic diagram of an image forming device incorporating an image heating apparatus according to this exemplary embodiment. The image forming device according to this exemplary embodiment is a color laser printer in which four image forming stations are arranged in tandem. An exemplary structure of the image forming device is described briefly below. In FIG. 2, a plurality of members having the same function is identified by adding different characters of an alphabet in front of their numerics. However, the alphabet characters are omitted in the description below except for a31 and b31.

Each image forming station (image forming unit) includes drum photoconductors 11, charging units 12 configured to charge the photoconductors 11, laser scanners 21 configured to scan the photoconductors 11 with a laser beam corresponding to image information, development units 13 configured to supply toner to the photoconductors 11 and develop electrostatic latent images formed on the photoconductors 11, and transfer units 22 configured to transfer toner images formed on the photoconductors 11 to an intermediate transfer belt 23. These four image forming stations produce four color toner images, and the four color toner images are superimposed on the intermediate transfer belt 23. A recording material fed from sheet cassettes 30 through pickup rollers 35 is conveyed to a transfer position by conveyance rollers 32. The toner image formed on the intermediate transfer belt 23 is transferred to the recording material conveyed to the transfer position. The recording material with the transferred toner image is conveyed to a fuser 40. The fuser 40 includes a fixing roller 41 incorporating a halogen lamp 43 and a pressure roller 42 incorporating a halogen lamp 44, and the fixing roller 41 and the pressure roller 42 constitute a fixing nip portion. The toner image on the recording material is thermally fixed to the recording material by being sandwiched and conveyed by the fixing nip portion. As will be described below, in a plain-paper recording mode, a recording material that has passed through the fuser 40 is ejected onto an output tray a31 by an output roller 34. In contrast, in a photograph mode which is used to form an image on a recording material for photographic image quality, a recording material that has passed through the fuser 40 is conveyed by an output roller 33, then turned over in a turning path 46, and sent to a gloss application unit (image heating apparatus) 50, which will be discussed below. The recording material that has passed through the gloss application unit 50 is ejected onto an output tray b31. A flapper 45 functions to direct a recording material that has passed through the fuser 40 toward the output tray a31 side or the output tray b31 side.

As described above, the image forming device according to this exemplary embodiment includes an image forming unit A and the gloss application unit (image heating apparatus) 50 and can select mode A (plain-paper recording mode) or mode B (photograph mode).

Figure 1:
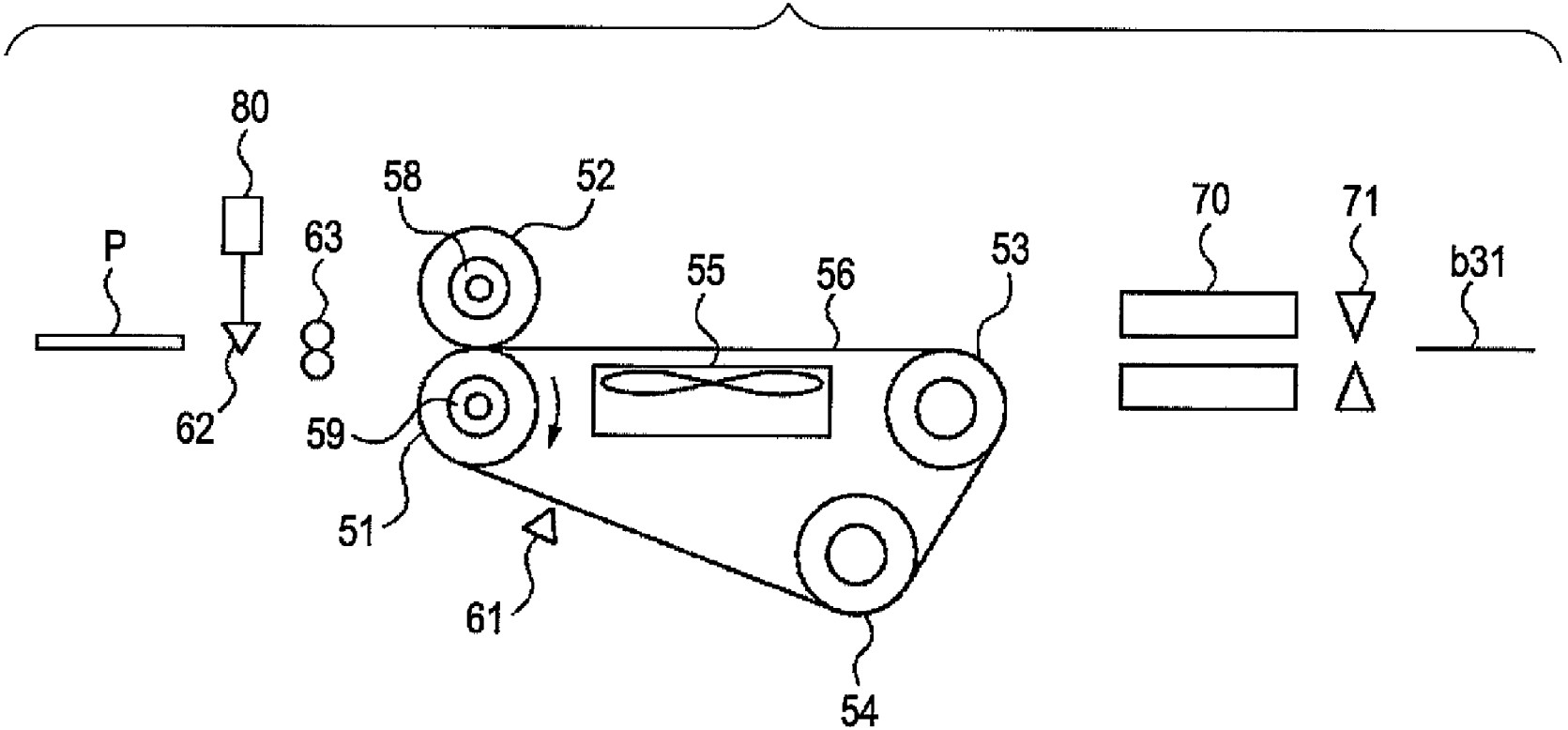
FIG. 1 is a schematic cross-sectional view of an image heating apparatus according to a first exemplary embodiment.

FIG. 1 is an enlarged view of the gloss application unit 50 illustrated in FIG. 2. The gloss application unit 50 includes a driving roller 51, a pressure roller 52, a rotation roller 53, a tension roller 54, a cooling fan (cooling member) 55, and an endless belt (sleeve-like belt) 56. The driving roller 51, the pressure roller 52, and the belt 56 disposed therebetween constitute a thermal nip portion.

The gloss application unit 50 further includes a reference-position detection sensor 61 configured to detect a reference position on the belt 56 in the circumferential direction, a recording-material detection sensor 62 configured to detect the leading end of a recording material P, and a pair of resist rollers 63.

Heaters (heating members) 59 and 58 are disposed inside the driving roller 51 and the pressure roller 52, respectively. The surface of each of the driving roller 51 and the pressure roller 52 is in contact with a thermistor (not shown). The energization of the heater 59 is controlled so as to maintain the detected temperature of the thermistor being in contact with the surface of the driving roller 51 at a predetermined temperature. The energization of the heater 58 is controlled so as to maintain the detected temperature of the thermistor being in contact with the surface of the pressure roller 52 at a predetermined temperature. A cutter (cutting unit) 70 is configured to cut an end of a recording material substantially parallel to a conveying direction of the recording material, and a cutter (cutting unit) 71 is configured to cut leading and trailing ends of the recording material.

The driving roller 51 can have a concentric three-layer structure having a core part, an elastic layer, and a release layer. The release layer functions to suppress dust and other foreign objects from attaching to the surface of the driving roller 51. The core part is formed from an aluminum hollow pipe having a diameter of about 44 mm and a thickness of about 5 mm. The elastic layer can be formed from silicone rubber having a JIS-A hardness of about 50°and a thickness of about 3 mm. The release layer can be formed from tetrafluoroethylene-perfluoroalkylvinylether copolymer (PFA) having a thickness of about 50 μm. The halogen lamp (heater) 59 serving as a heat source is disposed inside the hollow pipe of the core part. The pressure roller 52 has a similar structure.

The belt 56 has a two-layer structure including a mirror-like release layer at the front surface (which is in contact with the recording material P and the pressure roller 52) and a substrate at the back surface (which is in contact with the driving roller 51). The release layer can be formed from PFA having a thickness of about 10 μm. The substrate can be formed of a belt in which a stainless sheet having a thickness of about 100 μm is connected in an endless manner.

The cooling fan 55 is disposed inside the belt 56 in a cooling region. The cooling fan 55 generates an air flow toward the belt 56.

The belt 56 receives a predetermined tension from the tension roller 54 so that the curvature of the belt 56 in the cooling region is maintained at a substantially uniform curvature due to the stiffness of the belt 56. The belt 56 is rotated by rotation of the driving roller 51 in the direction of the arrow.

When electric power is supplied to the halogen lamps (heaters) 59 and 58 disposed inside the driving roller 51 and the pressure roller 52, respectively, the surface temperature of each of the driving roller 51 and the pressure roller 52 rises.

The recording material P is now described below.

Figure 3:
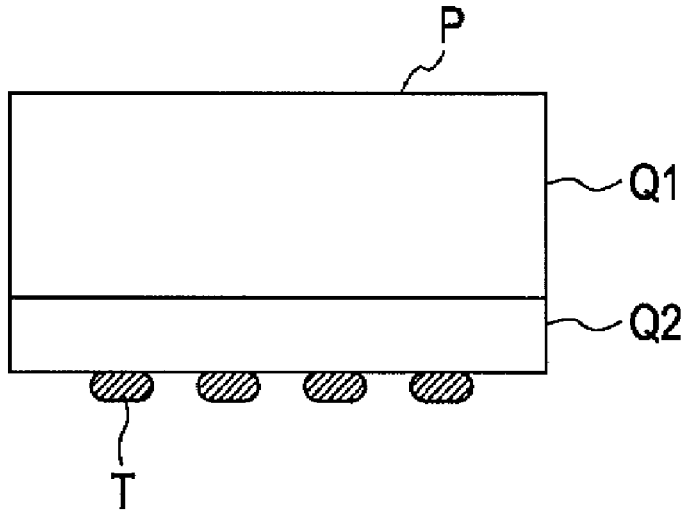
FIG. 3 illustrates a toner image and a recording material that have just been subjected to fixing processing performed by a fuser.

The recording material for use in this exemplary embodiment includes a substrate Q1 which includes a pigment-coated layer containing adhesive and pigment as the main ingredient disposed at at least one surface thereof and a resin layer Q2 disposed on the pigment-coated layer and containing thermoplastic resin as the main ingredient (see FIG. 3).

The resin layer Q2 can contain a thermoplastic resin as the main ingredient. The resin layer Q2 can be a mixed resin layer in which thermoplastic resin and thermosetting resin are mixed and can also be formed of a plurality of multiple layers including a thermoplastic resin layer containing thermoplastic resin as the main ingredient and a thermosetting resin layer containing thermosetting resin as the main ingredient.

Examples of the thermoplastic resin include polyester resin, styrene acrylic ester, styrene mathacrylate, and other resins as known by one of ordinary skill in the relevant art. In particular, the polyester resin is useful.

An exemplary normal operation of the gloss application unit 50 is described below. In this exemplary embodiment, the start timing of conveyance of the recording material is controlled so that the recording material is placed at a desired position on the belt 56 (the recording material comes into close contact with a desired position on the belt 56). The reason for controlling the position of placement of the recording material is to prevent foreign matter (e.g., paper powder) that remains on the belt after peeling off the leading edge of a previous recording material when the previous recording material is placed on the belt from attaching to an image area of a subsequent recording material.

The recording material P ejected from the image forming unit A first passes through the recording-material detection sensor 62, and a leading end PL of the recording material P is then sandwiched between the resist rollers 63 and temporarily stopped. At this time, the belt 56 continues rotating. The belt 56 has a mark indicating a reference position at a part in the circumferential direction. By the detection of the mark with the reference-position detection sensor 61, the reference position of the belt 56 in the circumferential direction can be identified. The start timing of conveyance of the recording material P stopping at the resist rollers 63 is determined on the basis of a signal from the reference-position detection sensor 61. The start timing of conveyance of the recording material is determined so that the time at which a desired recording-material placement position HT (see FIG. 9) on the belt 56 reaches the thermal nip portion is synchronism with the time at which the leading end PL of the recording material P reaches the thermal nip portion.

Figure 4:
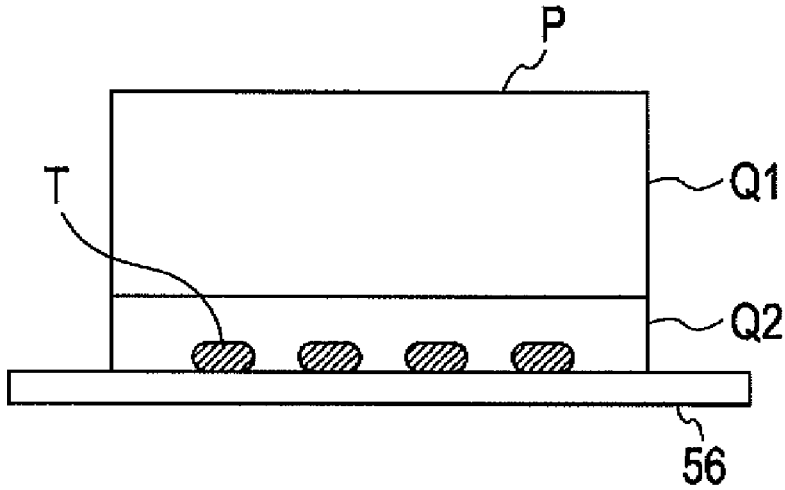
FIG. 4 illustrates a toner image and a recording material being subjected to gloss application processing performed by a gloss processing unit.

Upon reaching the start time of conveyance of the recording material, the resist rollers 63 start rotating again, and the recording material P is conveyed into the thermal nip portion. With the position HT on the belt 56 matching with the leading end PL of the recording material P, the recording material P passes through a pressure contact part (thermal nip portion) defined between the driving roller 51 and the pressure roller 52 via the belt 56 disposed therebetween. During this process, heat from the driving roller 51 and the pressure roller 52 is applied to the recording material P and toner T on the recording material P. As a result, the temperature of the transparent resin layer Q2 in the recording material P raises, so that the resin layer Q2 softens. Since the recording material P is sandwiched between the driving roller 51 and the pressure roller 52, pressure is exerted on the recording material P and the toner image T. As a result, the toner image changes from a state illustrated in FIG. 3 which is before the recording material P passes through the pressure contact part (in this state the toner image has been fixed because the recording material P has passed through the fuser 40 of the image forming unit A) to a state in which the toner image T sinks in the high-temperature transparent resin layer Q2 of the recording material P, as shown in FIG. 4. At the same time, the recording material P comes into closer contact with the surface of the belt 56.

The recording material P being in close contact with the belt 56 is then conveyed to the cooling region together with the rotation of the belt 56. In the cooling region, the recording material P is cooled in an efficient manner by the action of the cooling fan 55 and an air flow inside an air duct (not shown) surrounding the cooling fan 55. In this way, the recording material P being in close contact with the surface of the belt 56 is sufficiently cooled in the cooling region, and the recording material P is separated from the surface of the belt 56 due to the stiffness of the recording material P in a region where the curvature of the belt 56 is changed by the rotation roller 53.

After the separated recording material P passes through a conveyance path (not shown), the top, bottom, right, and left ends of the recording material P are cut by the cutters 70 and 71 with cutting widths WT and WY, and the recording material P is ejected onto the output tray b31. The cutting widths can be smaller or larger than margin widths of the recording material. If the cutting widths are smaller than the margin widths, margins remain on the recording material to be output; if the cutting widths are larger than the margin widths, no margins remain on the recording material to be output, i.e., a so-called frameless image is produced.

How the recording material P is separated (isolated) from the belt 56 is now described in detail with reference to the Figures.

Figure 5:
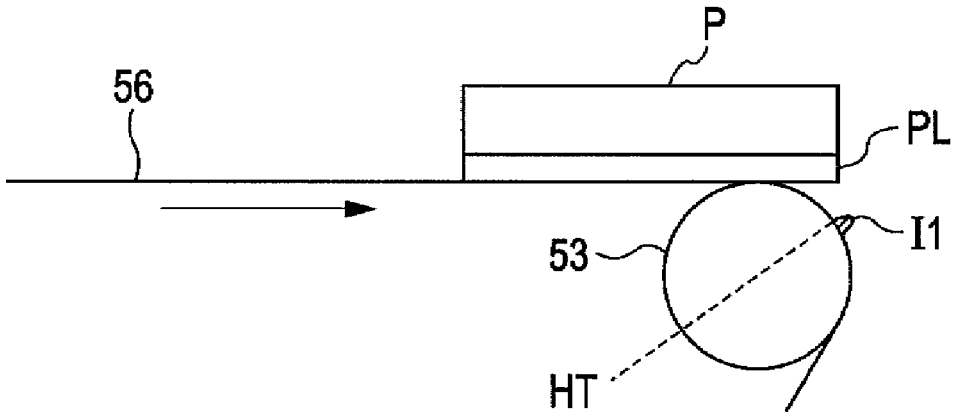
FIG. 5 is a cross-sectional view illustrating a state in which foreign matter is attached to a belt position HT from the leading edge of a recording material.

As illustrated in FIG. 5, when the position HT on the belt 56 reaches the region where the curvature of the belt 56 is changed by the rotation roller 53, the recording material P that has been conveyed in close contact with the surface of the belt 56 starts separating from the surface of the belt 56 due to the stiffness of the recording material P from the leading end PL of the recording material P.

Figure 6:
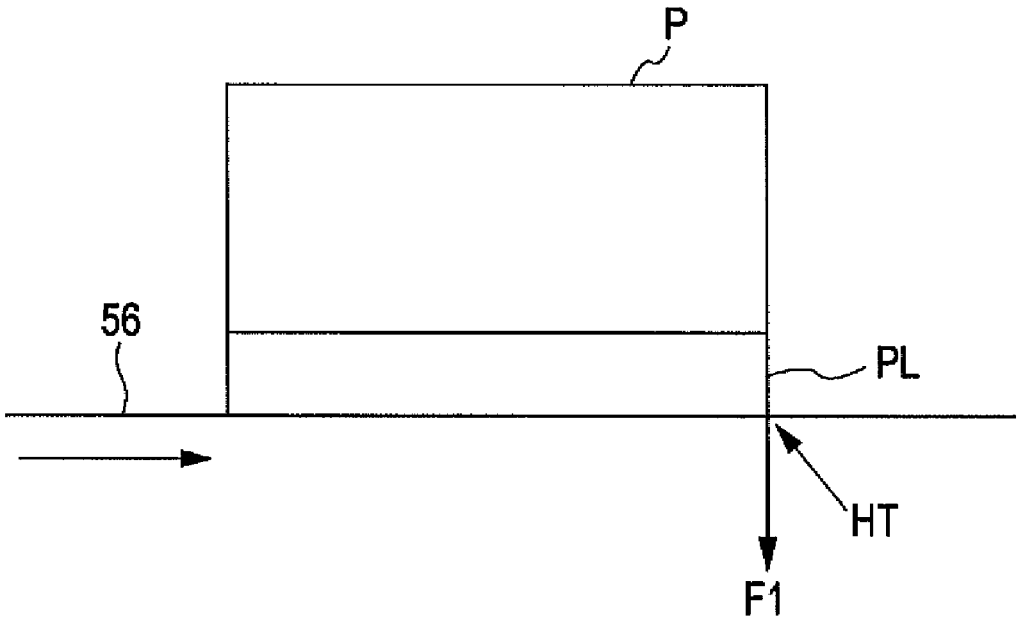
FIG. 6 illustrates a force applied to the leading edge of a recording material.

At this time, as illustrated in FIG. 6, the resultant F1 of cohesive force in the recording material P and adhesive force between the belt 56 and the recording material P is acted on the leading end PL of the recording material P (leading end in the direction of movement of the recording material). As a result, foreign matter I1 which is a mixture of minute amounts of resin and paper powder that has peeled off the resin layer Q2 of the recording material P is isolated from the recording material P and attached to the position HT on the belt 56.

In the case where a subsequent recording material P' is controlled so as to be placed at the identical position with that at which the previous recording material P is placed, with the aim of preventing the foreign matter I1 from attaching to an image area of a subsequent recording material P', i.e., in the case where the conveyance is controlled so that the leading end PL' of the recording material P' matches with the position HT on the belt 56, a phenomenon described below occurs.

When the conveyance of the subsequent recording material P' is controlled so that the leading end PL' of the subsequent recording material P' matches with the recording-material placement position HT, the leading end PL' of the subsequent recording material P' and the foreign matter I1 overlap each other on the belt 56. The recording material P' and the foreign matter I1 pass through a pressure contact part defined between the belt 56 and the pressure roller 52 and are conveyed to the cooling region. After the subsequent recording material P' and the foreign matter I1 reach the region where the curvature of the belt 56 is changed by the rotation roller 53, the subsequent recording material P' starts separating from the surface of the belt 56 due to the stiffness of the recording material from the leading end PL'.

Figure 7:
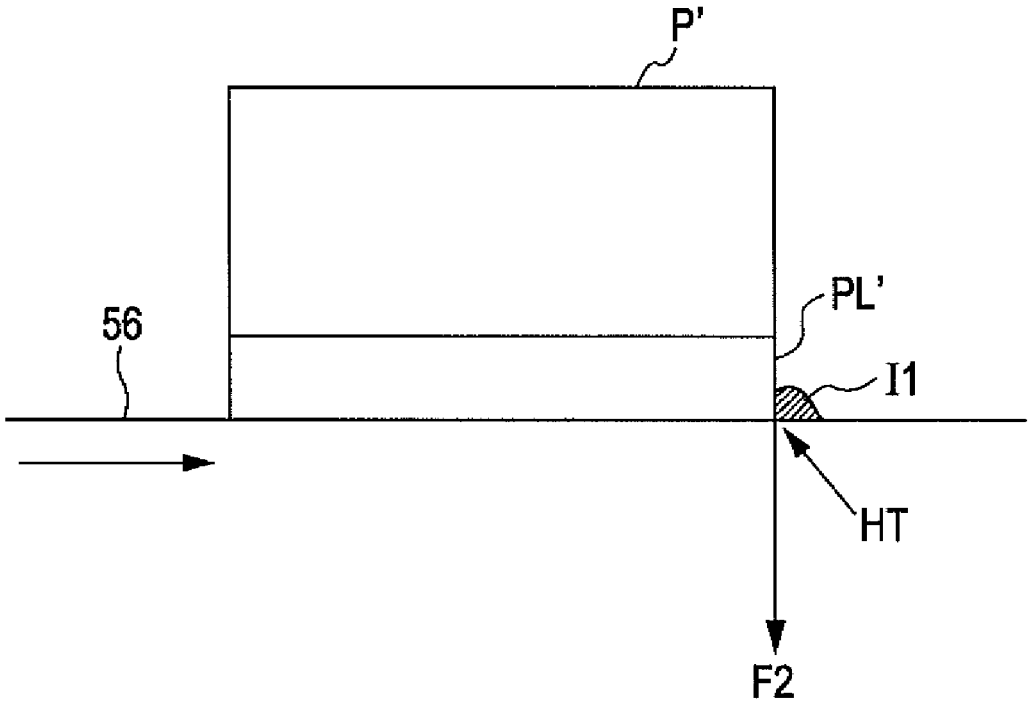
FIG. 7 illustrates a force applied to the leading edge of a recording material when the recording material is newly placed on the belt to which the foreign matter has been attached.
Figure 8:
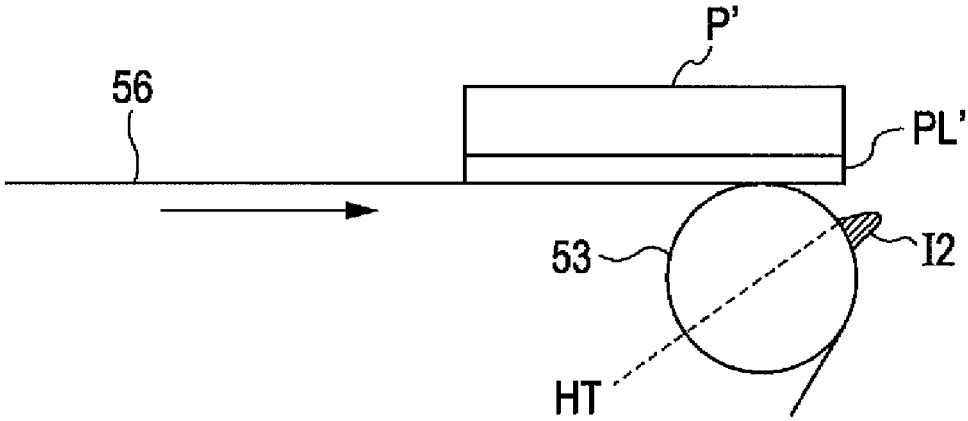
FIG. 8 is a cross-sectional view illustrating a state in which the foreign matter is attached to the position HT from the leading edge of a recording material when the recording material is newly placed on the belt to which the foreign matter has been attached.

At this time, as illustrated in FIG. 7, the resultant F2 (>F1) of cohesive force in the recording material P', adhesive force between the belt 56 and the subsequent recording material P', and adhesive force between the recording material P' and the foreign matter I1 is acted on the leading end (leading edge) PL' of the subsequent recording material P'. Therefore, as illustrated in FIG. 8, foreign matter I2 which is larger than the foreign matter I1 is isolated from the subsequent recording material P' and is attached to the position HT on the belt 56, and the belt 56 is moved while the foreign matter I2, which is larger than the foreign matter I1, remains attached to the position HT.

Figure 9:
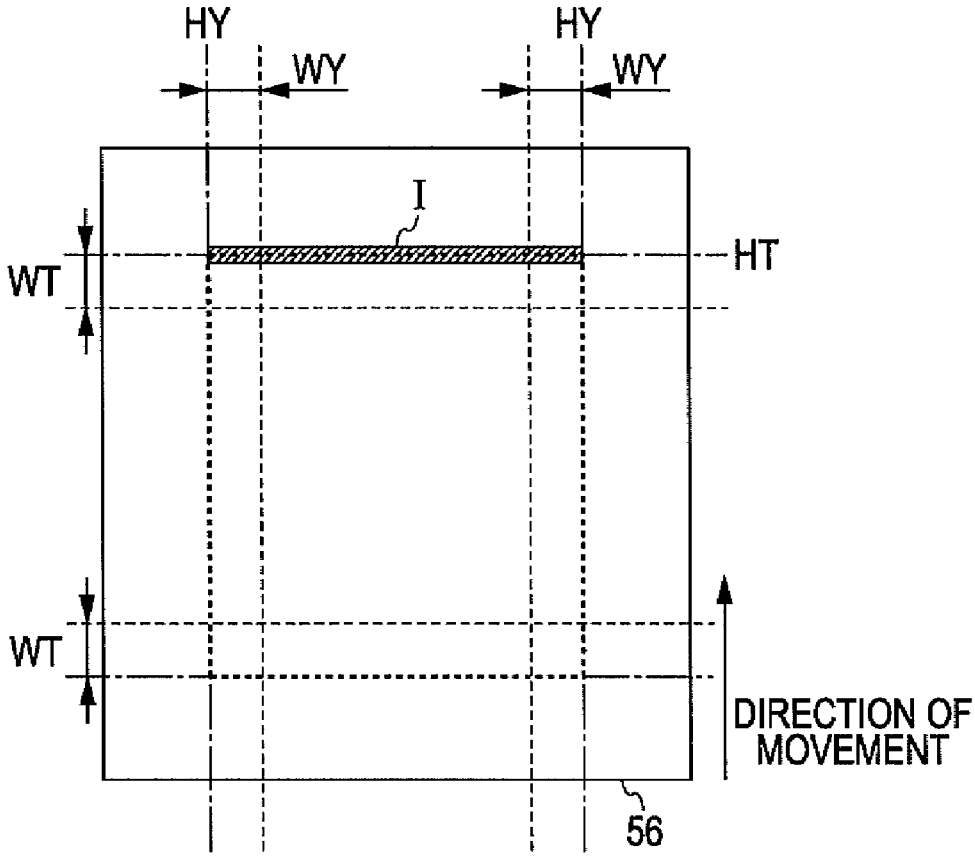
FIG. 9 illustrates a relationship among the belt, the foreign matter attached to the belt, and the cutting width.
Figure 10:
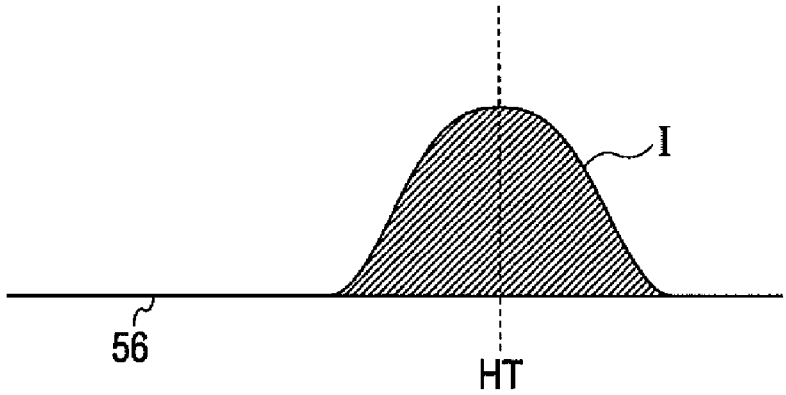
FIG. 10 illustrates a distribution of the foreign matter.

When the same gloss application processing operation is repeated, as illustrated in FIG. 9, foreign matter I is increased each gloss application processing operation and accumulated. As illustrated in FIG. 10, the foreign matter I attached on the belt 56 is normally distributed so as to be centered on the position HT on the belt 56. The width of the foreign matter I distribution is determined depending on the margin of the amount of shifting of the start timing of conveyance at the resist rollers 63. Therefore, when the foreign matter is accumulated on the belt, the durability of the belt decreases.

In addition, the foreign matter on the belt causes error of separation of the recording material from the belt.

To address this, the gloss application unit 50 according to this exemplary embodiment performs control is described below.

Figure 13:
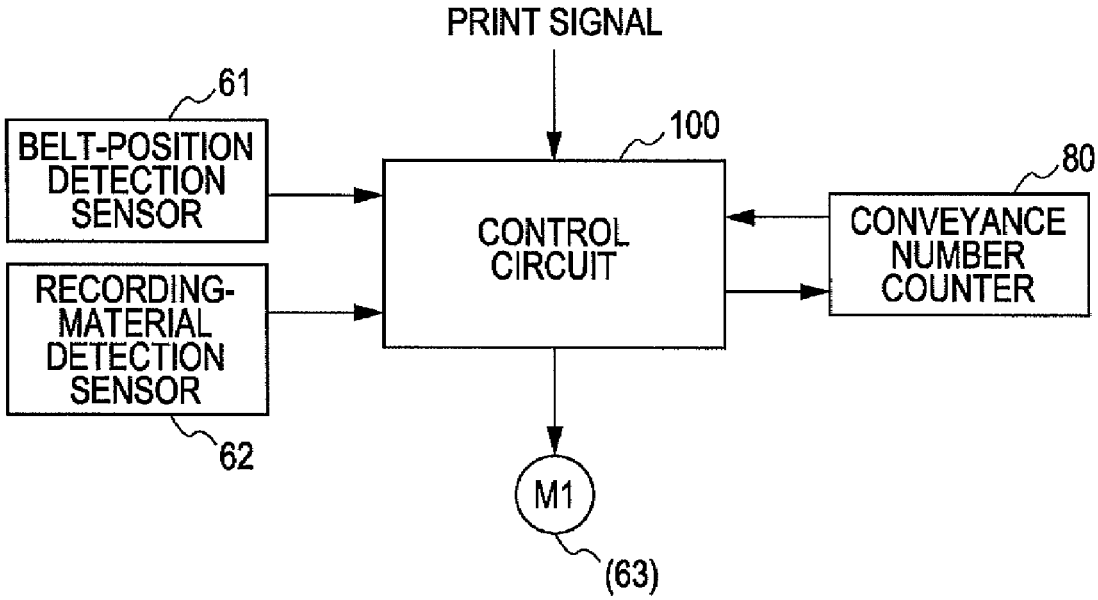
FIG. 13 is a block diagram of a processing circuit in the image heating apparatus.
Figure 14:
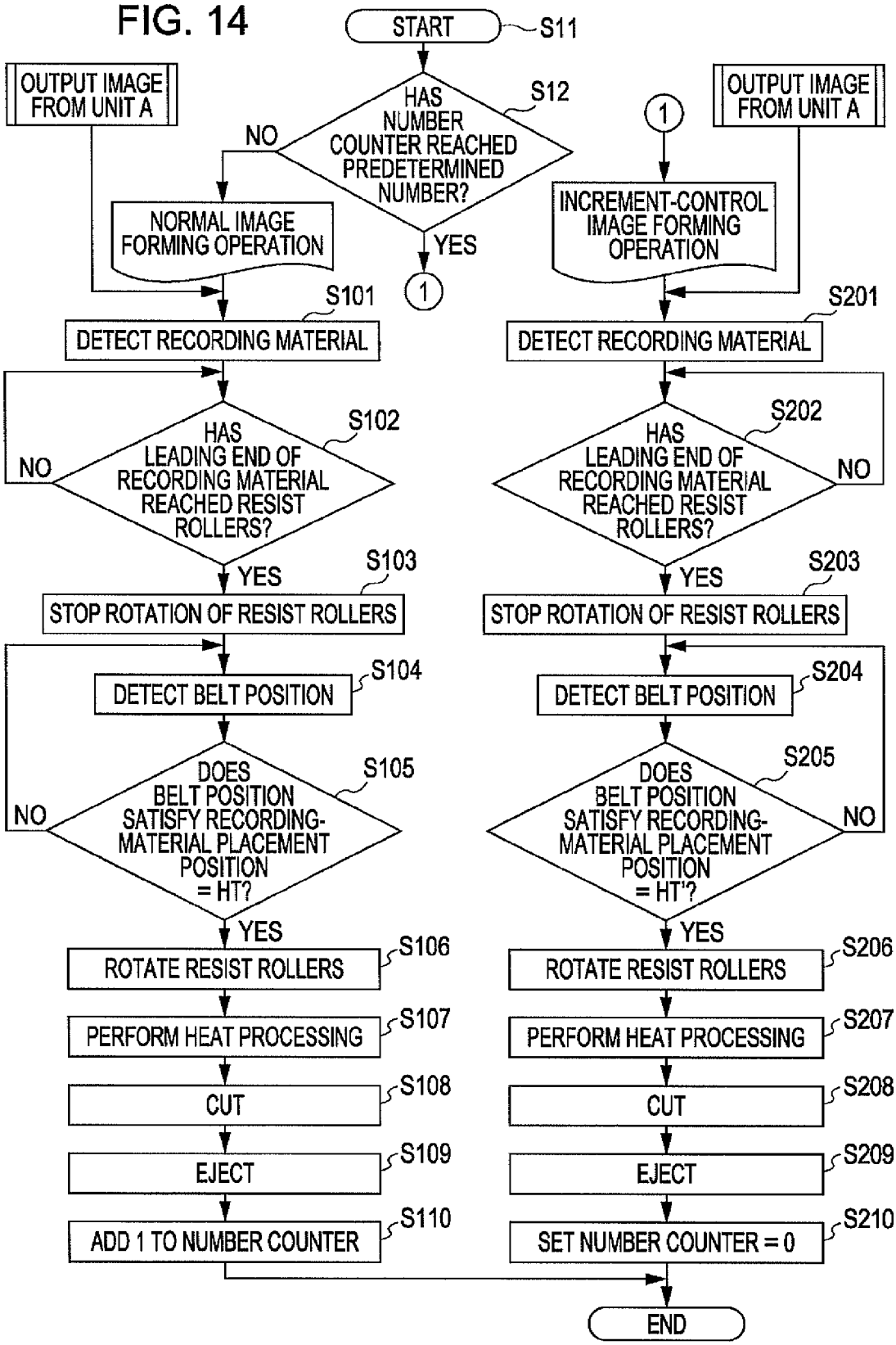
FIG. 14 is a flowchart according to the first exemplary embodiment.
Figure 15:
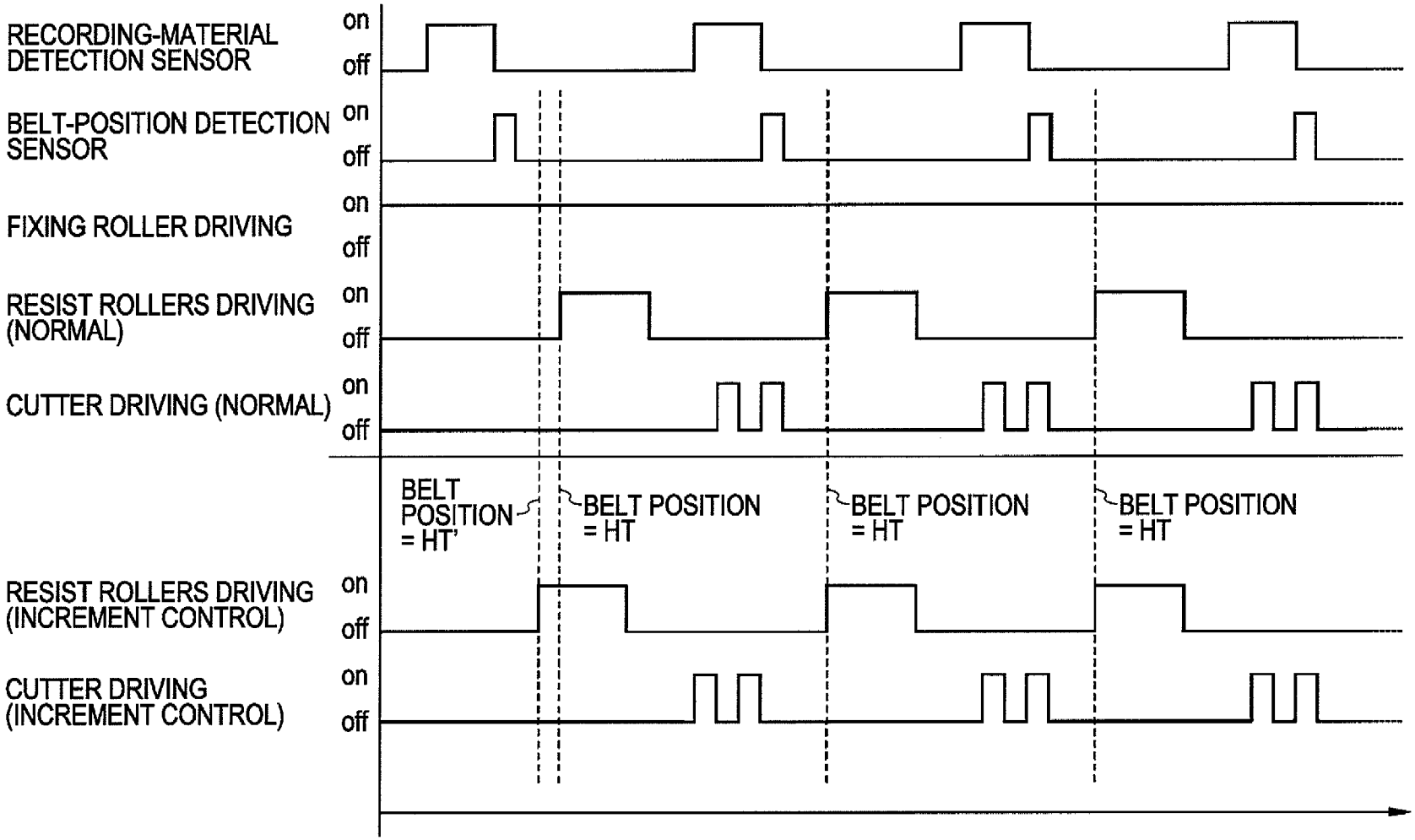
FIG. 15 is a timing diagram according to the first exemplary embodiment.

First, the recording-material detection sensor 62 is provided with a conveyance number counter 80 configured to count the number of conveyed recording materials. When the count number of the conveyance number counter 80 reaches a desired conveyance number, the start timing of conveyance of the recording material at the resist rollers 63 is shifted, thereby performing control in which the recording-material placement position is changed (shifted) from the position HT to the position HT' (hereinafter referred to as increment control) (S11-S12 and S201-S210 in FIG. 14). FIG. 13 is a block diagram of a circuit for performing this control. In FIG. 13, M1 refers to a motor for driving the resist rollers 63. A control circuit 100 controls the motor M1 according to outputs of the reference-position detection sensor 61, the recording-material detection sensor 62 and the conveyance number counter 80. FIG. 14 is a flowchart according to this exemplary embodiment. FIG. 15 is a timing diagram according to this exemplary embodiment. In this exemplary embodiment, the number of recording materials that can be placed on the belt during one rotation of the belt 56 is one.

An exemplary operation of the gloss application unit 50 when the increment control is performed is described below.

The subsequent recording material P' ejected from the image forming unit A first passes through the recording-material detection sensor 62, and then, the leading end of the subsequent recording material P' is sandwiched between the resist rollers 63 and is stopped temporarily (S201-S203 in FIG. 14). The start timing of conveyance of the recording material P' stopping at the resist rollers 63 is determined on the basis of a signal from the reference-position detection sensor 61, as in the case of operation that does not perform increment control. The start timing of conveyance of the recording material is determined so that the time at which a desired recording-material placement position HT' on the belt 56 reaches the thermal nip portion is synchronism with the time at which the leading end PL' of the recording material P' reaches the thermal nip portion. Upon reaching the start time of conveyance of the recording material, the resist rollers 63 start rotating again, and the recording material P' is conveyed into the thermal nip portion (S204-S206 in FIG. 14).

Figure 11:
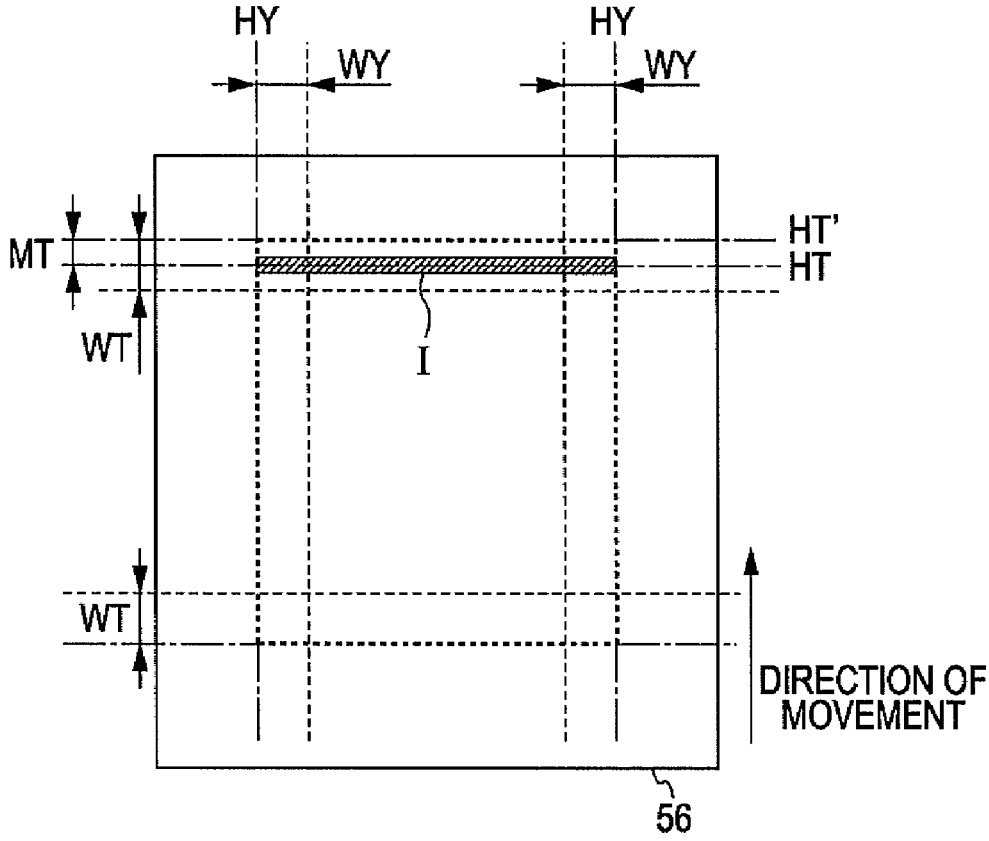
FIG. 11 illustrates a relationship among the belt, the foreign matter attached to the belt, and the cutting width.

As illustrated in FIG. 11, the recording-material placement position HT' is set to be downstream of the normal recording-material placement position HT in the conveying direction of the recording material on the belt 56. In other words, in the case where the recording material is placed so that the leading end thereof matches with the position HT', the start timing of conveyance of the recording material is faster than that in the case where the recording material is placed so that the leading end thereof matches with the position HT. The cutting width WT for cutting the leading and trailing ends of the recording material is set to be equal to or larger than the distance MT between the recording-material placement positions HT' and HT (referred to as shift width). It is useful that WT>MT. It can also be set that relationships of WT≧MT and the margin widths≧MT are both satisfied.

If the cutting width and the shift width are set so as to satisfy WT≧MT, the foreign matter I deposited on the position HT on the belt 56 when the previous recording material P is present within the cutting area of the recording material used for increment control (subsequent recording material) P'. As a result, the foreign matter I left by the previous recording material P is removed when the subsequent recording material P' is separated from the belt 56, and the foreign matter I is then discarded when the subsequent recording material P' is cut. Therefore, when the recording material P' is ejected onto the output tray b31, the foreign matter I is not attached thereto.

Figure 12:
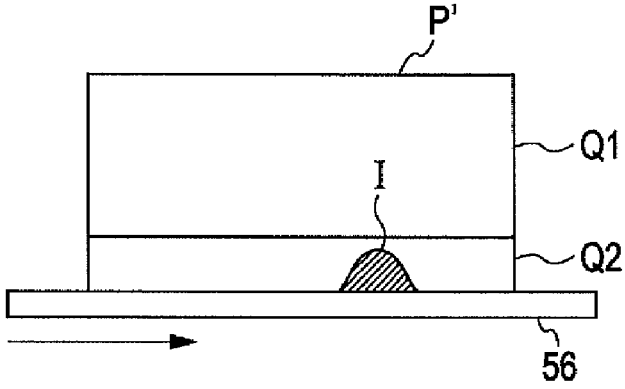
FIG. 12 illustrates a state in which the foreign matter on the belt sinks in a resin layer of a recording material.

In the gloss application processing operation during increment control, the foreign matter I deposited on the belt 56 and the subsequent recording material P' overlapping the foreign matter I pass through the pressure contact part defined between the belt 56 and the pressure roller 52. During this process, since heat from the driving roller 51 and the pressure roller 52 is applied to the recording material P', the temperature of the transparent resin layer Q2 in the recording material P' raises and the resin layer Q2 softens. In addition, pressure produced by the driving roller 51 and the pressure roller 52 is applied to the recording material P' and the foreign matter I thereon. As a result, as illustrated in FIG. 12, the foreign matter I sinks in the high-temperature transparent resin layer Q2 in the recording material P', like the toner image in the normal gloss application processing operation.

Then, the recording material P' is conveyed to the cooling region, is sufficiently cooled, and is separated from the surface of the belt 56 due to the stiffness of the recording material P in the region where the curvature of the belt 56 is changed by the rotation roller 53 (S207 in FIG. 14), as with the case of the normal gloss application processing operation.

At this time, since the foreign matter I that was attached to and accumulated on the position HT on the belt 56 sinks in the recording material P', the foreign matter I is isolated from the surface of the belt 56 together with the recording material P'. Therefore, no foreign matter remains on the position HT.

The separated recording material P' passes through the conveyance path (not shown), the top, bottom, right, and left ends of the recording material P' are cut by the cutters 70 and 71 with cutting widths WT and WY, and the recording material P is then ejected onto the output tray b31 (S208-S210 in FIG. 14), as with the case of the normal gloss application processing operation.

At this time, the foreign matter I on the recording material P' is removed together with the cut margin of the recording material P' when the recording material P' is cut with the cutting width WT. Therefore, no foreign matter remains on the output image. In this way, since the foreign matter I1 which was attached to the belt 56 in the process of the gloss application processing for the previous recording material P is removed from the belt 56 by attaching to the cutting area of the subsequent recording material P', the amount of foreign matter accumulated on the belt 56 can be suppressed. Furthermore, since the area of the recording material to which the foreign matter is attached is an area to be cut, the adverse effects to an image output from the image forming device can also be suppressed.

How the recording material P' is separated in the increment control is now described in detail with reference to the Figures.

Figure 16:
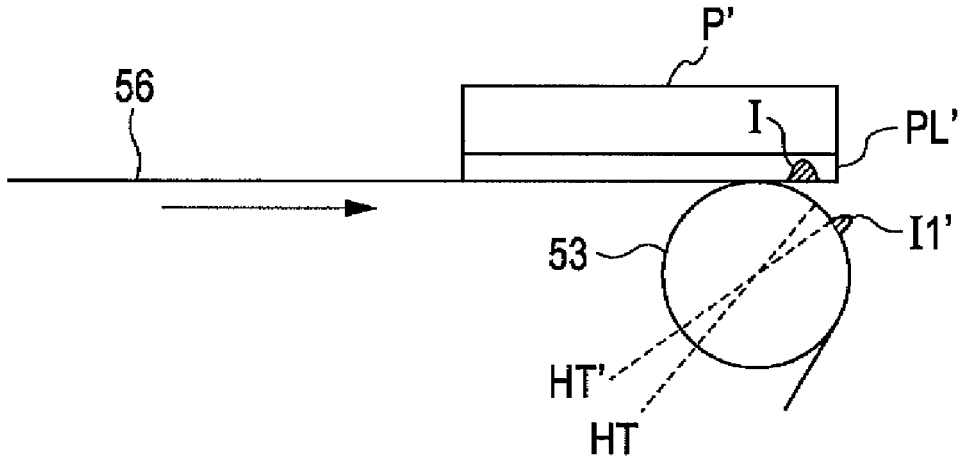
FIG. 16 illustrates the position of the foreign matter in the case where increment control has been performed.

As illustrated in FIG. 16, when the position HT' on the belt 56 reaches the region where the curvature of the belt 56 is changed, the subsequent recording material P'conveyed in close contact with the surface of the belt 56 starts separating from the surface of the belt 56 due to the stiffness of the recording material from the leading end.

Figure 17:
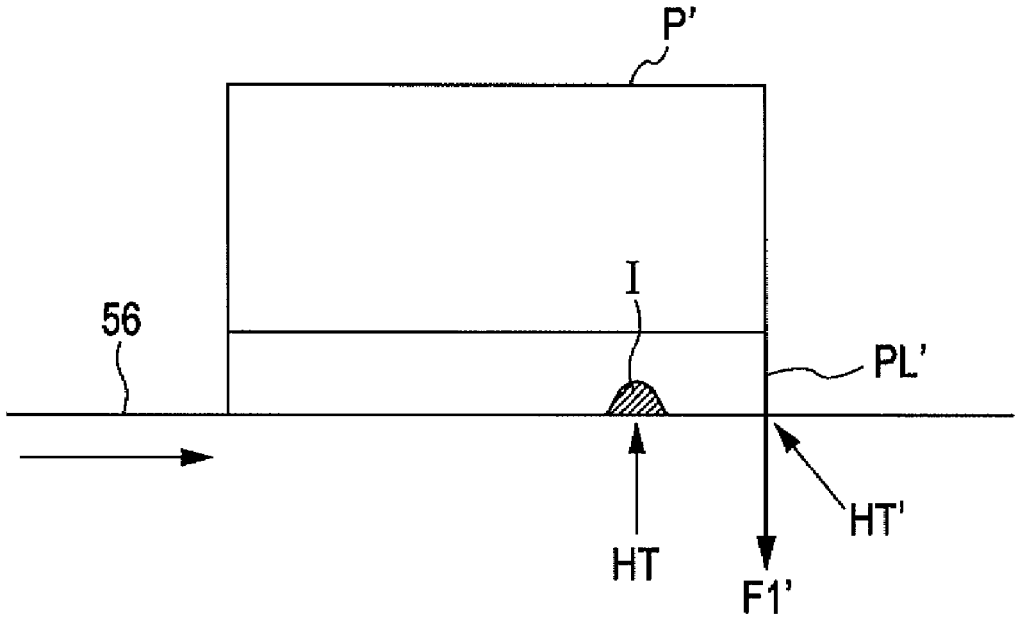
FIG. 17 illustrates a force applied to the leading edge of a recording material in the case where increment control has been performed.

At this time, as illustrated in FIG. 17, the resultant F1' of cohesive force in the recording material P'and adhesive force between the belt 56 and the recording material P' is acted on the leading end PL' of the recording material P'. As a result, foreign matter I1', which is a mixture of minute amounts of resin and paper powder that has peeled off the resin layer Q2 of the recording material P', is isolated from the recording material P' and attached to the position HT' on the belt 56. The belt 56 is moved while the foreign matter I1' remains attached to the position HT'. The resultant F1' is substantially the same as the resultant F1 which is applied to the leading end PL of the recording material P in the normal separation operation. Therefore, the amount of the foreign matter I1' attached to the position HT' on the belt 56 is much smaller than the sum of the foreign matter I1 which is attached and accumulated in the case where the increment control is not performed (FIG. 7). As a result, error of separation of the recording material from the belt can be suppressed.

In this exemplary embodiment, the increment control is performed for every predetermined number of recording materials. Therefore, after the recording material P', which is a target of the increment control, passes through the recording-material detection sensor 62, the counter value of the conveyance number counter 80 is cleared back to zero, and the processing with respect to the recording materials subsequent to the recording material P' shifts to the normal gloss application processing operation. The intervals of the increment control can be any interval as long as error of separation of the recording material does not occur and can be set appropriately. A case in which 100 recording materials are continuously processed is described below with reference to the flowcharts of FIGS. 14 and 15. For example, in the case where the increment control is performed at intervals of one per ten recording materials, the first to ninth recording materials are subjected to operation of the left-hand part (S101-S110) of the flowchart of FIG. 14, and the tenth recording material is subjected to operation of the right-hand part (S201-S210) of the flowchart of FIG. 14. The 11th to 19th recording materials are subjected to the operation of the left-hand part (S101-S110) of the flowchart of FIG. 14, and the 20th recording material is subjected to the operation of the right-hand part (S201-S210) of the flowchart of FIG. 14. Such processing is repeated until the count of the number of processed recording materials reaches 100.

When the processing shifts to the normal gloss application processing operation (the left-hand flowchart (S101-S110)), the recording material P can be placed on the belt 56 with reference to the position HT again. Therefore, the foreign matter I1' attached to the position HT' on the belt 56 does not increase during the normal gloss application processing operation.

In other words, since the amount of foreign matter attached to and accumulated on the position HT' on the belt 56 increases only during the increment control, even when the gloss application processing operation is continuously performed over a long period of time, the amount of foreign matter attached to and accumulated on the belt 56 can be significantly reduced. As a result, a decrease in the separability of a recording material from a conveyance separation portion on the belt 56 can be suppressed, and the amount of accumulated foreign matter, which may damage the belt 56, can be reduced. The durability of the belt 56 can be secured over a long period of time.

As described above, in the normal gloss application processing operation (the left-hand part (S101-S110) of the flowchart of FIG. 14), the resist rollers are driven so that the recording material is placed such that the leading end thereof matches with the position HT on the belt. In the increment-control gloss application processing operation (the right-hand part (S201-S210) of the flowchart of FIG. 14), the recording material is placed so that the leading edge thereof matches with the position HT' by shifting the timing of drive of the resist rollers. After this operation, the position of placement of the recording material returns to the position HT.

Figure 18:
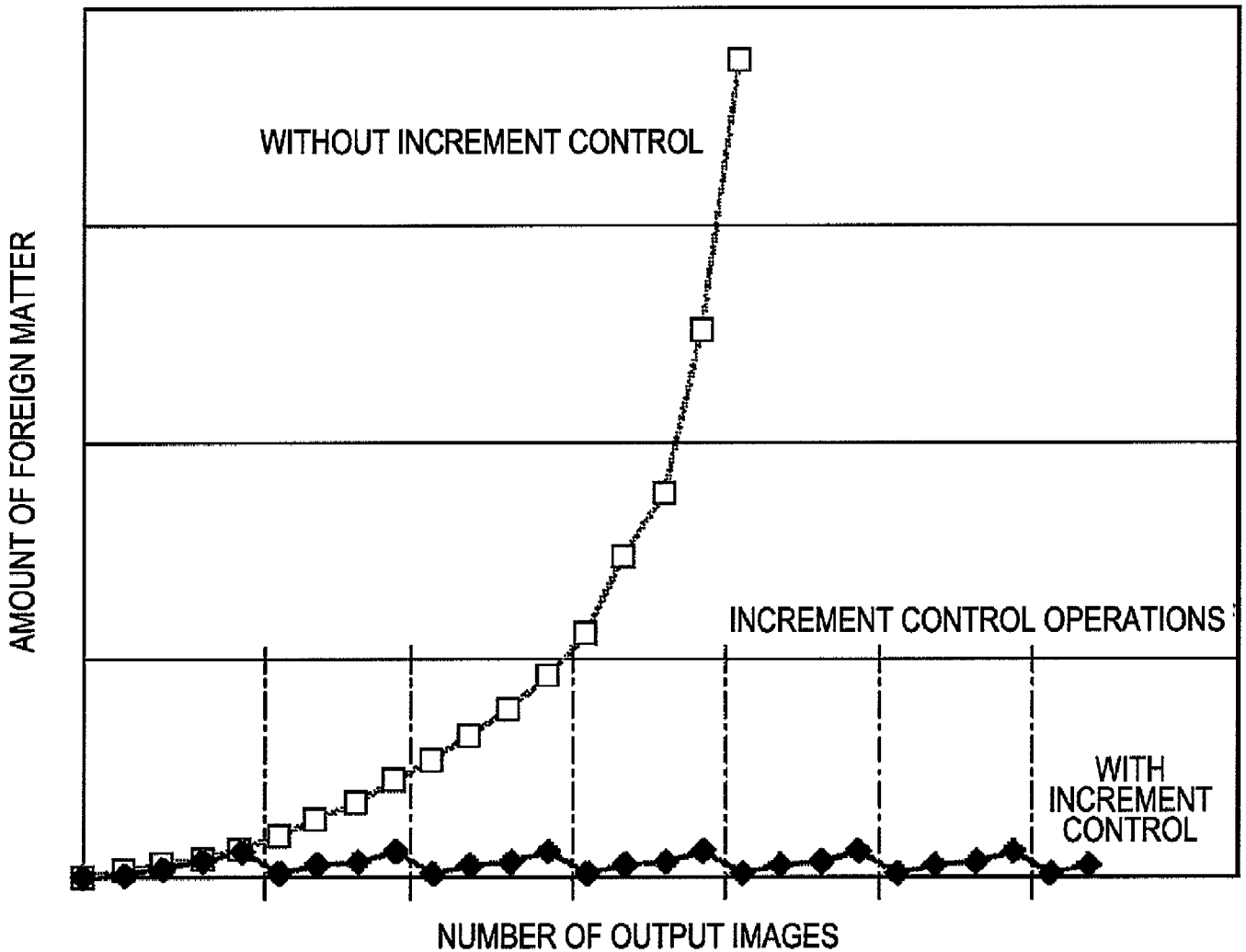
FIG. 18 illustrates the amount of foreign matter with respect to the number of output images in the case where the increment control has been performed and in the case where the increment control has not been performed.

As a comparative example to this exemplary embodiment, a case is described below in which images are output by processing of placing the leading edge of each recording material so that the leading end thereof matches with the position HT alone without the use of control of shifting the position of placement of the recording material, i.e., the increment control. Changes in the amount of foreign matter such as paper powder and a resin component on the fixing belt with respect to the number of output images for the comparative example and the first exemplary embodiment are illustrated in the graph of FIG. 18.

As previously described in the first exemplary embodiment, if images are output by performing normal image forming operation alone, the resultant applied to the leading edge of the recording material when the recording material is separated from the belt increases with output images. Therefore, the separability of the leading edge of the recording material decreases and the amount of foreign matter on the belt synergistically increases.

In contrast to this, in the case of the first exemplary embodiment, even if the image output is continuously performed, since the amount of foreign matter on the belt is reduced in the increment control, the amount of foreign matter on the belt decreases over a long period of time.

In the first exemplary embodiment, the amount of shifting of the recording-material placement position from HT to HT' is the distance MT, which is a fixed amount. However, the amount of shifting is not necessarily a fixed amount. In the present invention, control is performed so that the position HT' of placement of the recording material P for control operation is not the same as the position HT of the previous recording material P. Therefore, any amount of shifting can be used as long as the recording-material placement position HT and the recording-material placement position HT' for control operation do not overlap each other. However, in terms of simplicity, control with a fixed amount of shifting would be useful.

Second Exemplary Embodiment

Figure 19:
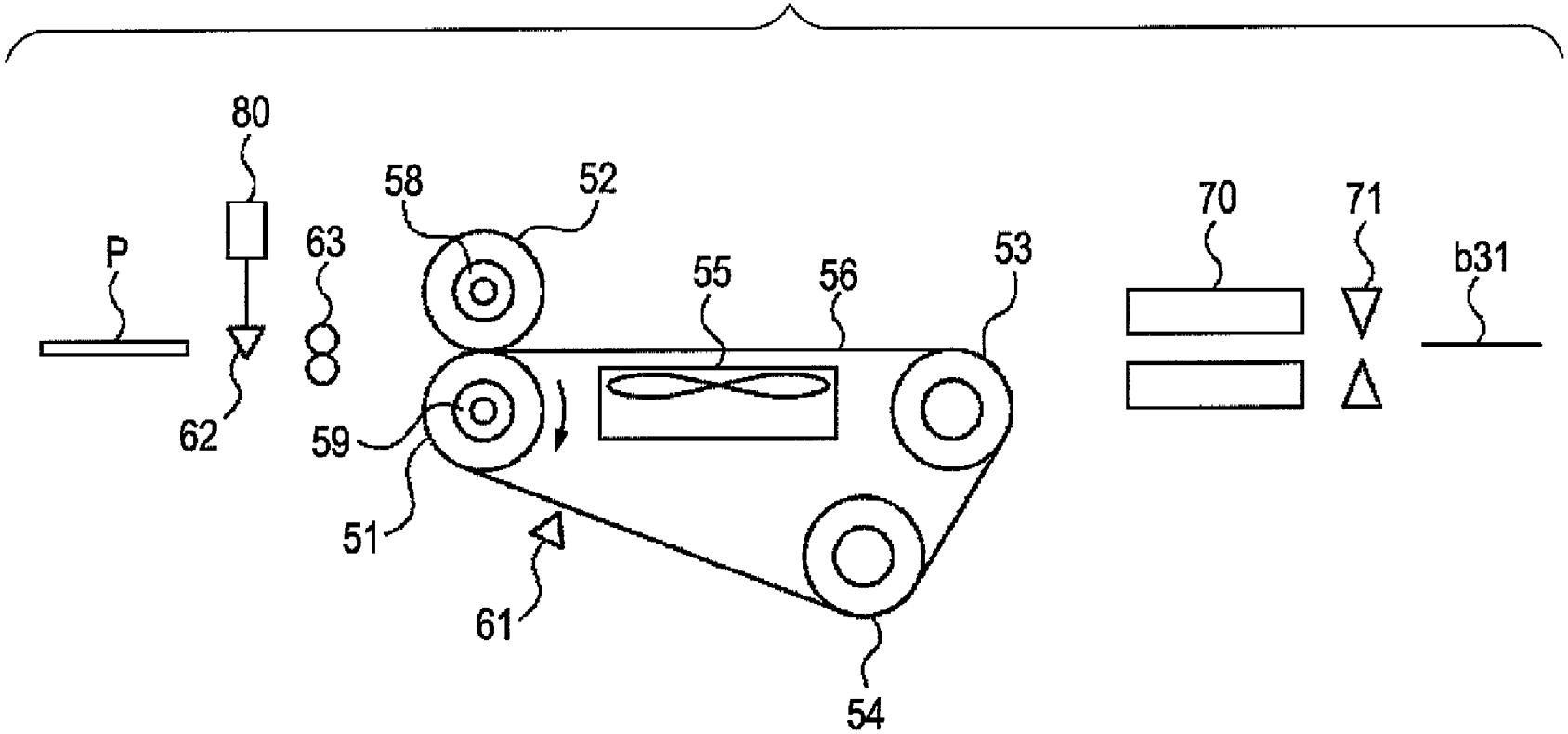
FIG. 19 is a schematic cross-sectional view of an image heating apparatus according to a second exemplary embodiment.

FIG. 19 illustrates the structure according to the second exemplary embodiment. The image forming unit is the same as that in the first exemplary embodiment, and the description thereof is not repeated here.

The major difference between the first and second exemplary embodiments is that the tension roller 54 is provided with a cam (not shown) and a belt-movement mechanism for moving the belt 56 in a direction orthogonal to the conveying direction is disposed in the second exemplary embodiment. The belt 56 can be a single-layer endless belt formed from silicone rubber having a thickness of about 110 μm.

The fundamental structure, such as other rollers, the cooling region, cutters, and recording materials, is substantially the same as that in the first exemplary embodiment.

Figure 20:
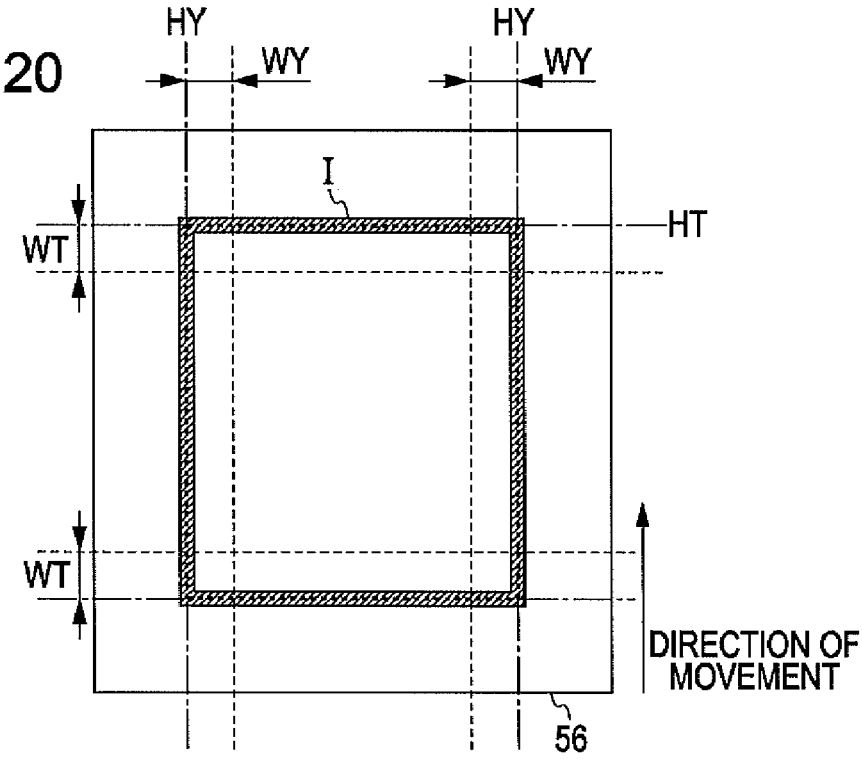
FIG. 20 illustrates a relationship among the belt, the foreign matter attached to the belt, and the cutting width.
Figure 25A:
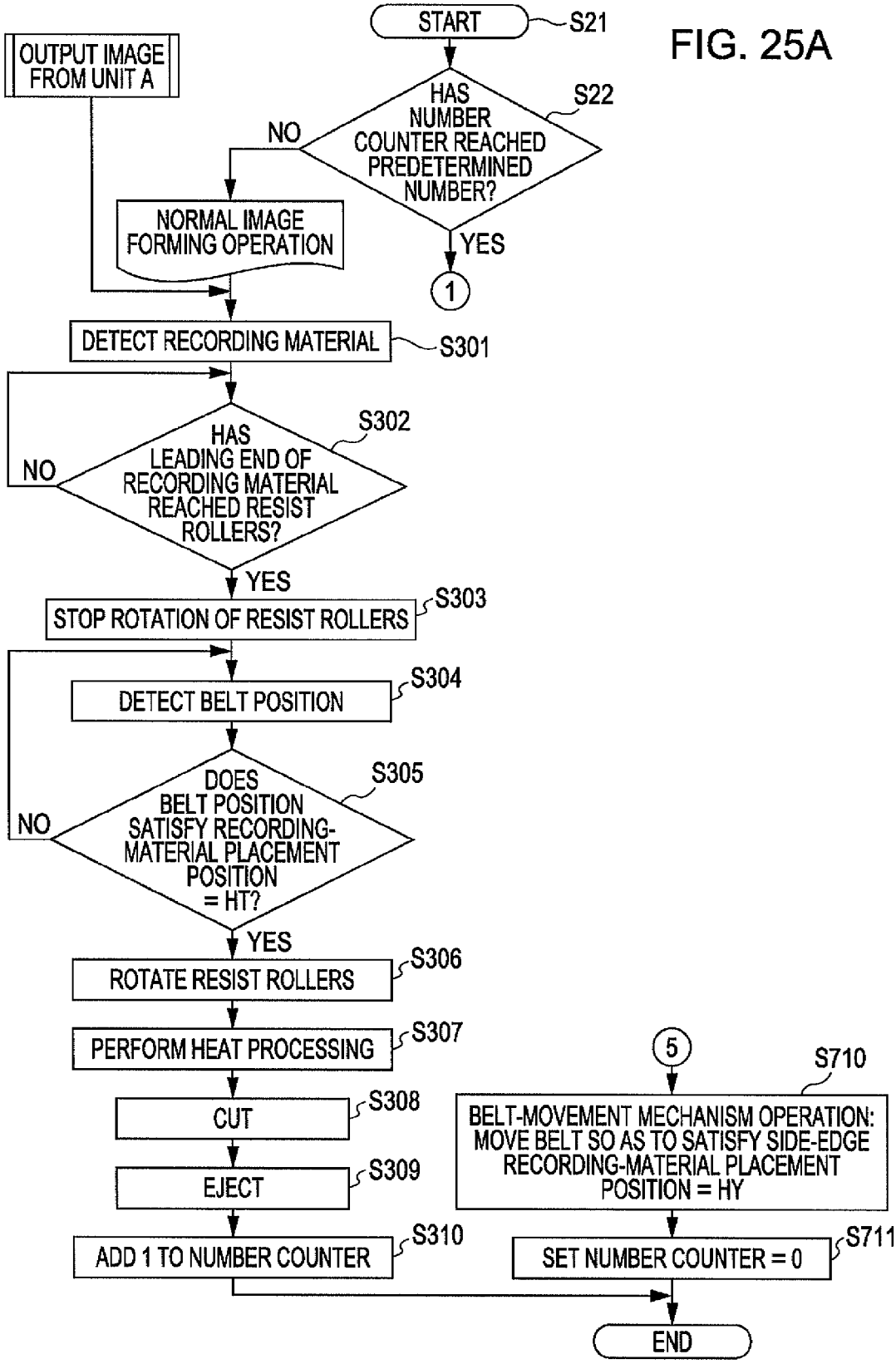
FIGS. 25A-25E are flowcharts according to the second exemplary embodiment.

The normal gloss application processing operation is substantially the same as that in the first exemplary embodiment (S21-S22 and S301-S310 in FIG. 25A). Therefore, when the gloss application processing operation is repeated, the foreign matter I attached to and accumulated on the position HT and position HY, which is parallel to the conveying direction on the belt 56, increases for every gloss application processing operation, as illustrated in FIG. 20.

In this exemplary embodiment, when the gloss application processing operation is repeated and the counter value of the conveyance number counter 80 reaches a predetermined number, control (hereinafter referred to as increment control) is performed in which the position of placement of the leading end of the recording material on the belt 56 is shifted from the position HT to the position HT1 and the position HT2 by shifting the timing of conveyance of the recording material P with the resist rollers 63, while at the same time the side-edge placement position of placement of the recording material on the belt 56 is shifted from the position HY to the position HY1 and the position HY2 by actuating the belt-movement mechanism performed by the tension roller 54. In other words, the increment control is completed by using four recording materials.

An exemplary gloss application processing operation in the increment control is described below.

Figure 25B:
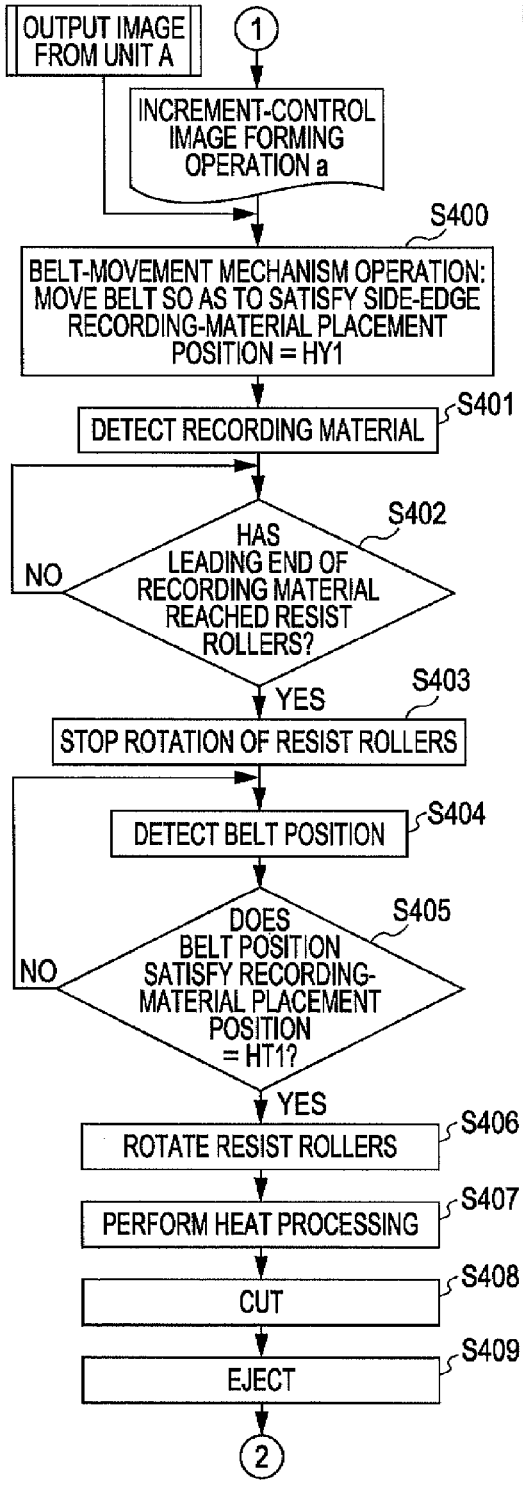

In the increment control, the cam (not shown) and the tension roller 54 operate so that the side-edge placement position of a first recording material Pa on the belt 56 is shifted from the position HY to the position HY1, thus moving the belt 56 in the direction orthogonal to the conveying direction (S400 in FIG. 25B).

The recording material Pa is then output from the image forming unit A and passes through the recording-material detection sensor 62 via the conveyance member 46 (S401 in FIG. 25B). The leading edge of the recording material Pa is sandwiched between the resist rollers 63, and the recording material Pa is stopped temporarily (S402-S403 in FIG. 25B). At this time, the belt 56 continues rotating.

The reference position of the belt 56 is detected by the reference-position detection sensor 61 (S404 in FIG. 25B). The resist rollers 63 start rotating again so that the time at which the recording-material placement position HT1 on the belt 56 reaches the thermal nip portion is in synchronism with the time at which the leading edge of the recording material Pa reaches the thermal nip portion (S405-S406 in FIG. 25B), thus conveying the recording material Pa into the thermal nip portion.

Figure 21:
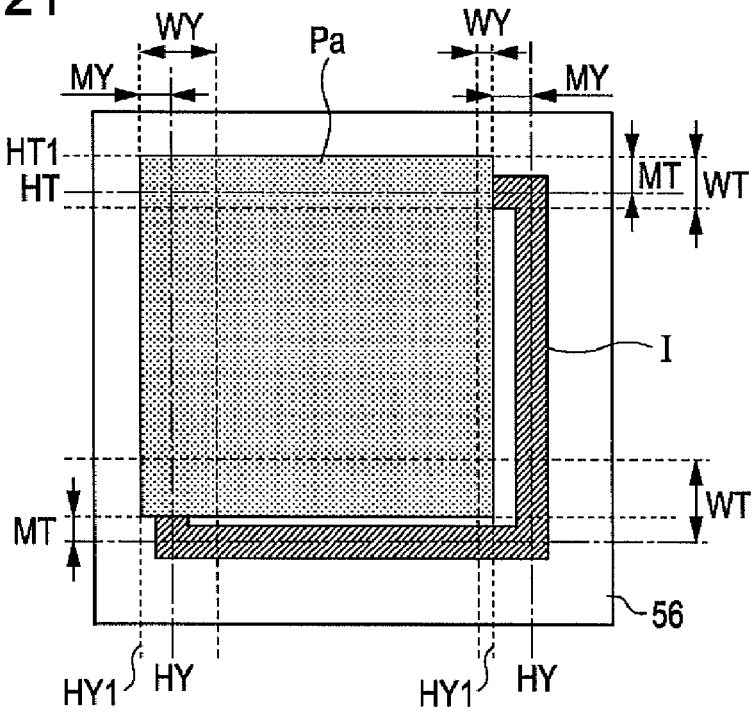
FIG. 21 illustrates a position of placement of a recording material in increment control according to the second exemplary embodiment.

As illustrated in FIG. 21, the recording-material placement position HT1 is set to be downstream of the normal recording-material placement position HT in the conveying direction of the recording material. The cutting width WT when the leading and trailing ends of the recording material is set to be longer than the distance MT between the recording-material placement positions HT1 and HT. The cutting width WY is set to be longer than the distance MY between the side-edge recording-material placement positions HY1 and HY.

Therefore, the foreign matter I accumulated on the belt 56 in the normal gloss application processing operation is present within the margin area to be cut of the recording material Pa in the increment control.

In the increment control, the foreign matter I sinks in the high-temperature transparent resin layer Q2 in the recording material Pa, as with the case of the first exemplary embodiment. At the same time, the recording material Pa comes into close contact with the surface of the belt 56.

Then, the recording material Pa is conveyed to the cooling region, is sufficiently cooled, and is separated from the surface of the belt 56 due to the stiffness of the recording material in the region where the curvature of the belt 56 is changed by the rotation roller 53, as with the case of the normal gloss application processing operation (S407 in FIG. 25B).

At this time, the foreign matter I that was attached to and accumulated on the position HT on the belt 56 and that was attached adjacent to the left side of the recording material sinks in the recording material Pa. Therefore, the foreign matter I is separated from the surface of the belt 56, so that no foreign matter remains on the position HT and the lift-side position HY.

After the separated recording material Pa passes through the conveyance path (not shown), the top, bottom, right, and left ends of the recording material Pa are cut by the cutters 70 and 71 with cutting widths WT and WY, and the recording material Pa is ejected onto the output tray b31 (S408-S409 in FIG. 25B). The cutter 70 in this exemplary embodiment moves in the direction orthogonal to the conveying direction together with the movement of the belt 56 in that direction.

Since the foreign matter I on the recording material Pa is cut together with the margin of the recording material Pa when the recording material Pa is cut with the cutting widths WT and WY, no foreign matter remains on output images. Therefore, the image output operation in the increment control can offer output image quality substantially the same as that in the normal image output operation.

Figure 22:
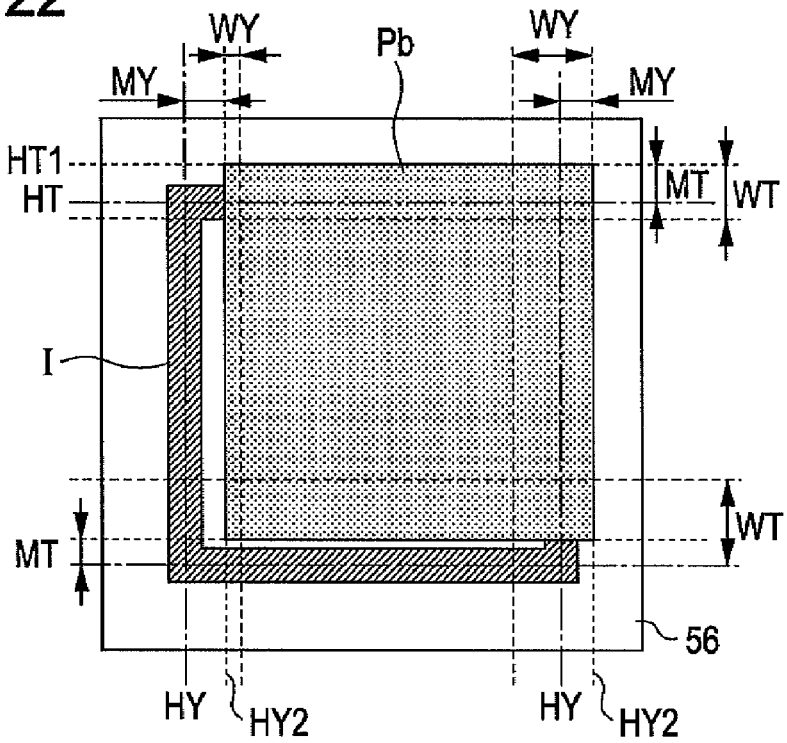
FIG. 22 illustrates a position of placement of a recording material in increment control according to the second exemplary embodiment.
Figure 25C:
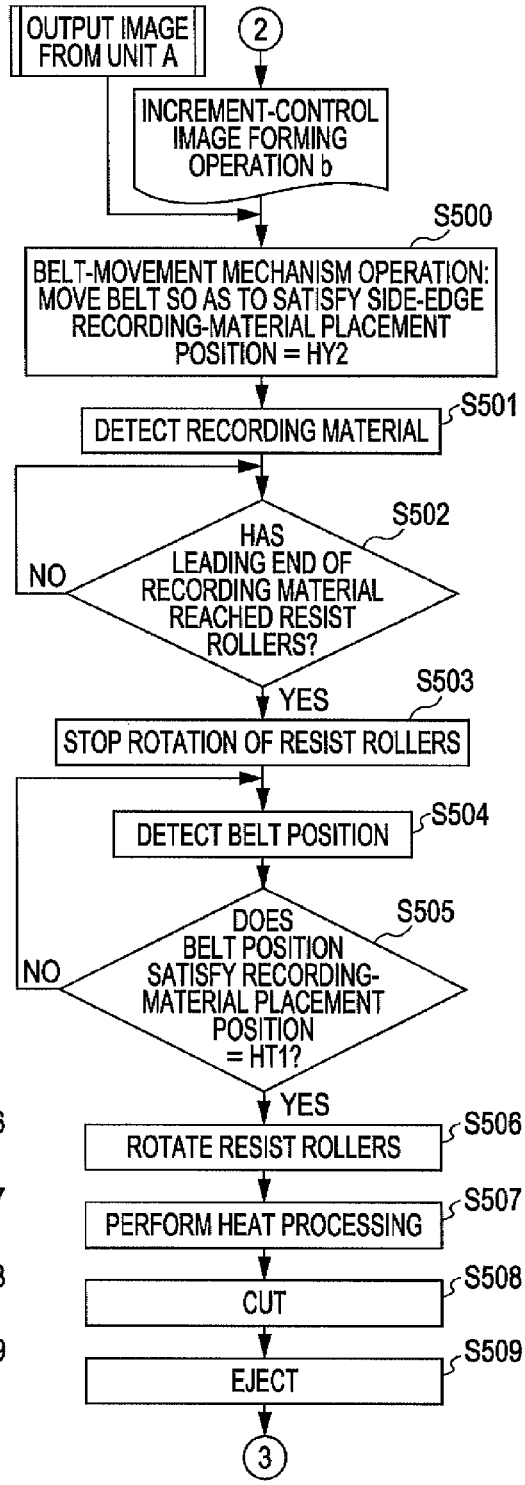

The increment control of a recording material Pb subsequent to the recording material Pa is illustrated in FIG. 22. As illustrated in FIG. 22, the cam (not shown) and the tension roller 54 operate so that the side-edge placement position of the recording material Pb on the belt 56 is shifted to the position HY2, thus moving the belt 56 in the direction orthogonal to the conveying direction. The position of placement of the recording material Pb in the conveying direction is the same as that of the recording material Pa. The recording material Pb being in close contact with the belt 56 is heated and cooled. The four sides of the recording material Pb separated from the belt 56 are cut with the cutting widths WT and WY (S500-S509 in FIG. 25C).

Figure 23:
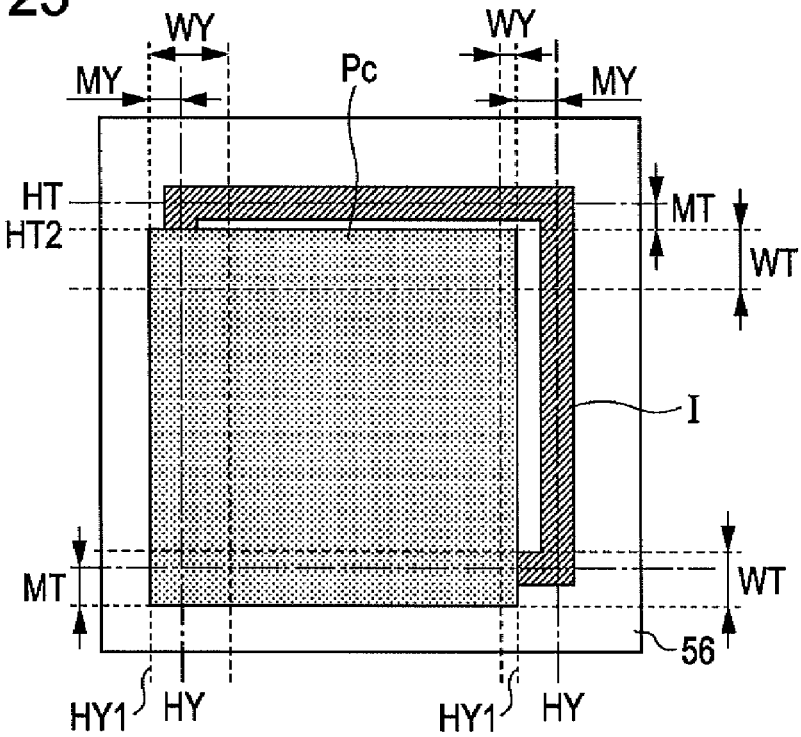
FIG. 23 illustrates a position of placement of a recording material in increment control according to the second exemplary embodiment.
Figure 25D:
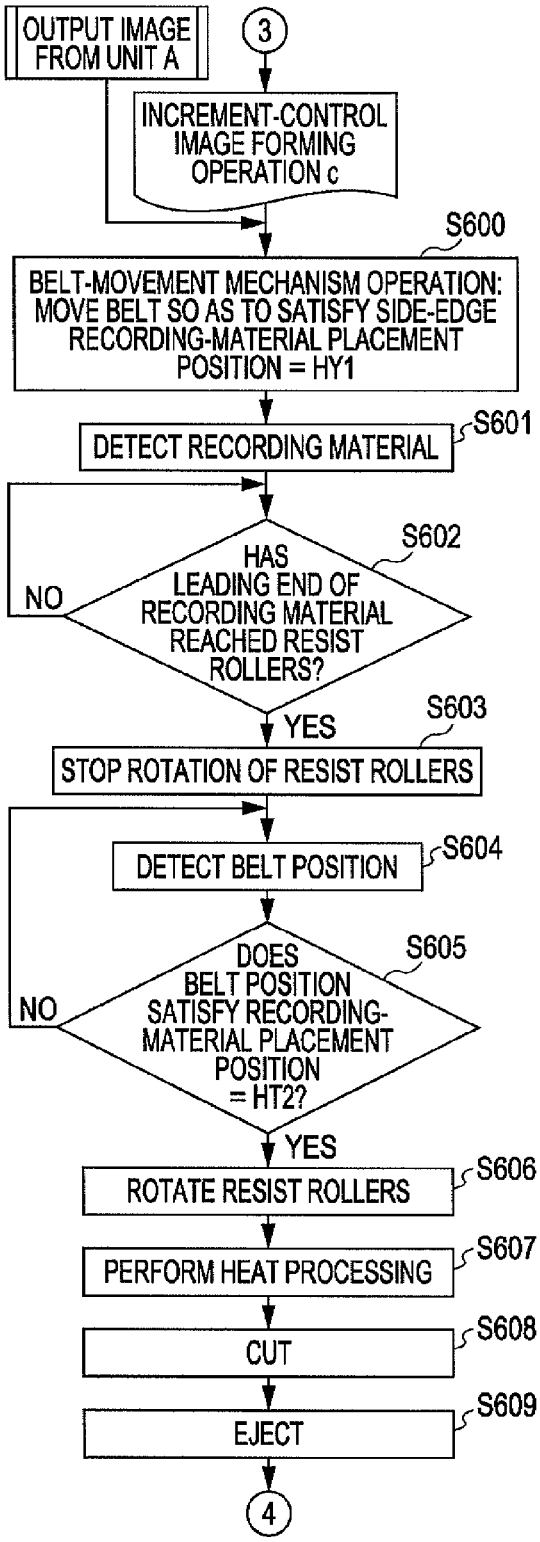

The increment control of a recording material Pc subsequent to the recording material Pb is illustrated in FIG. 23. As illustrated in FIG. 23, the cam (not shown) and the tension roller 54 operate so that the side-edge placement position of the recording material Pc on the belt 56 is shifted to the position HY1, thus moving the belt 56 in the direction orthogonal to the conveying direction. The position of placement of the recording material Pc in the conveying direction is different from the position of the recording materials Pa and the Pb, and the conveyance of the recording material Pc starts so that the leading edge of the recording material Pc is located downstream of the position HT on the belt 56. The recording material Pc being in close contact with the belt 56 is heated and cooled. The four sides of the recording material Pc separated from the belt 56 are cut with the cutting widths WT and WY (S600-S609 in FIG. 25D).

Figure 24:
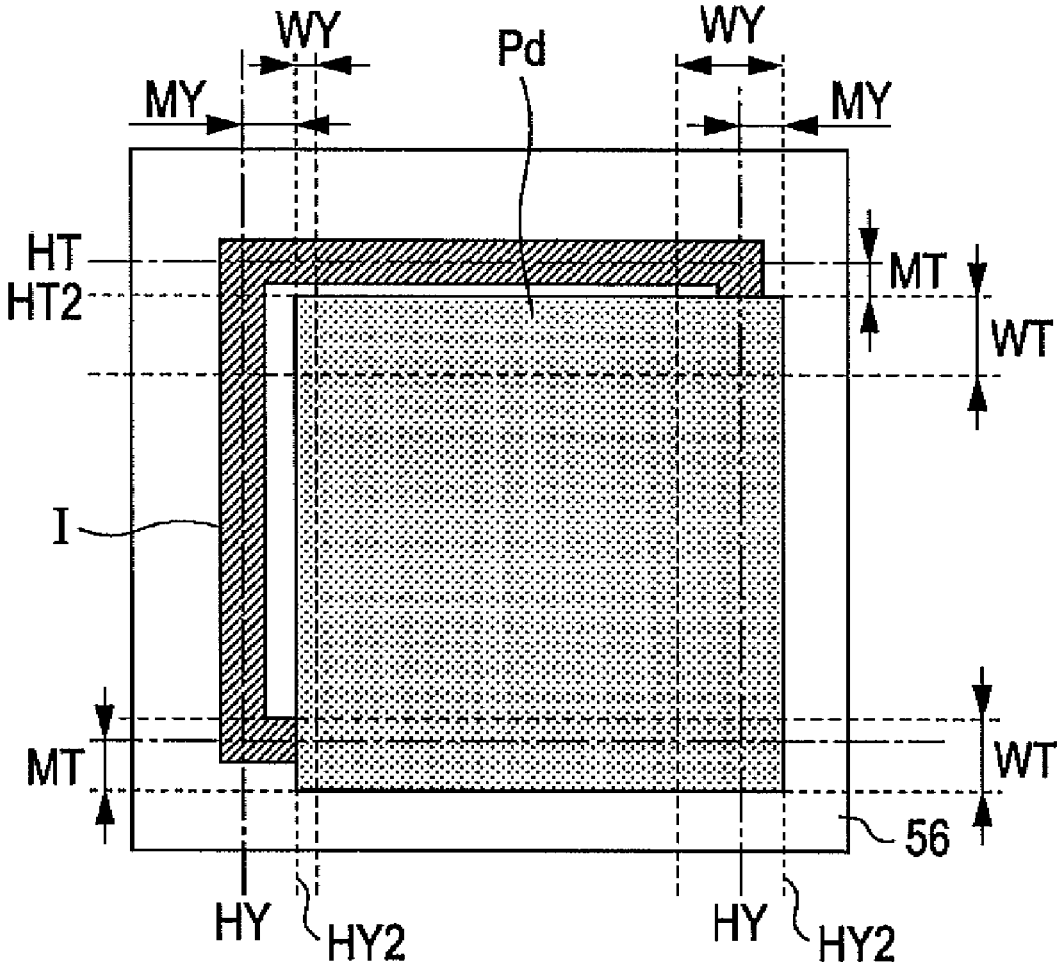
FIG. 24 illustrates a position of placement of a recording material in increment control according to the second exemplary embodiment.
Figure 25E:
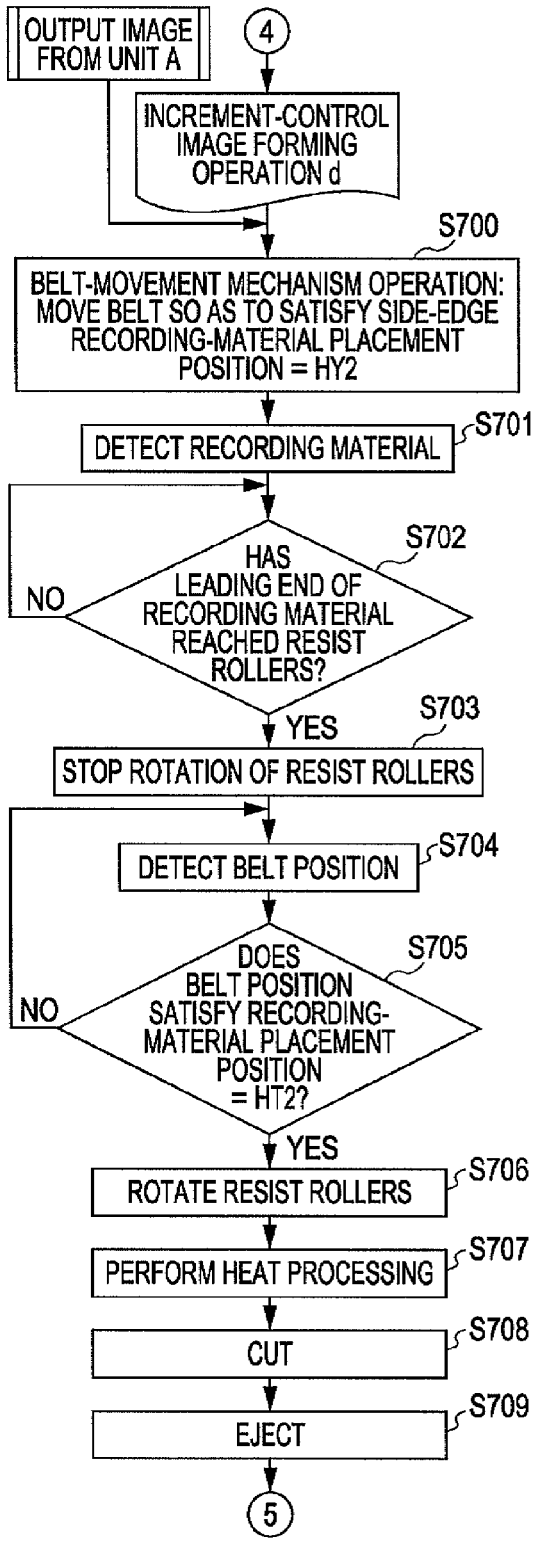

The increment control of a recording material Pd subsequent to the recording material Pc is illustrated in FIG. 24. As illustrated in FIG. 24, the cam (not shown) and the tension roller 54 operate so that the side-edge placement position of the recording material Pd on the belt 56 is the position HY2, thus moving the belt 56 in the direction orthogonal to the conveying direction. The position of placement of the recording material Pd in the conveying direction is the same as that of the recording material Pc. The recording material Pd being in close contact with the belt 56 is heated and cooled. The four sides of the recording material Pd separated from the belt 56 are cut with the cutting widths WT and WY (S700-S709 in FIG. 25E). The increment control is completed by using these four recording materials Pa to Pd. The recording materials subsequent to the recording material Pd is placed at the normal placement positions (so that the ends match with the positions HT and HY) and is in close contact with the belt (S301-S310 in FIG. 25A).

The order can be set freely. For example, an order of FIG. 22, FIG. 24, FIG. 23, and FIG. 21 can offer the similar advantages.

As a result, all the foreign matter that was attached to and accumulated on the belt 56 in the normal gloss application processing operation is removed.

Then, the counter value of the conveyance number counter 80 is cleared back to zero (S710-S711 in FIG. 25E), and the processing shifts to the normal gloss application processing operation (S21-S22 and S301-S310 in FIG. 25A).

Therefore, since the recording material P can be placed on the belt 56 with reference to the positions HT and HY again, the foreign matter attached to the belt 56 does not increase during the normal gloss application processing operation.

In other words, since the amount of foreign matter attached to and accumulated on the belt 56 increases only during the increment control, even when the gloss application processing operation is continuously performed over a long period of time, the amount of foreign matter attached to and accumulated on the belt 56 can be significantly reduced. As a result, a decrease in the separability of a recording material from the conveyance separation portion on the belt 56 can be suppressed, and the amount of accumulated foreign matter, which may damage the belt 56, can be reduced. The durability of the belt 56 can be secured over a long period of time. The flowcharts of the control processing described above are illustrated in FIGS. 25A to 25E.

In this exemplary embodiment, the belt-movement mechanism for moving the belt 56 in the direction orthogonal to the conveying direction realized by the tension roller and the cam provided to the tension roller functions as a changing unit for changing the position of placement of the recording material on the belt in the direction orthogonal to the conveying direction. However, a unit for moving the belt is not limited to the unit in this exemplary embodiment and can be a known unit. Alternatively, the use of a unit for shifting the recording material itself at the conveyance portion in the direction orthogonal to the conveying direction with a guide or other known members before the recording material enters the pressure contact part defined between the belt 56 and the pressure roller 52 without the use of the unit for moving the belt can offer the similar advantages.

In the first and second exemplary embodiments described above, when the processing returns to the normal control from the increment control, the counter value of the counter of the number of conveyed materials is cleared back to zero and the recording-material placement position on the belt returns to the positions HT and HY. However, when the processing returns to the normal control from the increment control, the counter value of the counter of the number of conveyed materials is cleared back to zero, the recording-material placement position on the belt can remain unchanged (not return to the positions HT and HY). In this case, the normal gloss application processing operation is set to be performed in the unchanged positions, and, when the counter value reaches a predetermined number again, the recording-material placement position is shifted by the distances MT and MY. The foreign matter on the belt is removed similarly, and therefore, the similar advantages can be obtained. In the first and second exemplary embodiments, the conveyance number counter functions as a detection unit for setting the timing at which the processing shifts to the increment control. In place of such a unit, other known units or methods, such as a counter for measuring the number of rotations of the belt and use of the number of image outputs, can be used.

Third Exemplary Embodiment

The third exemplary embodiment performs control so that the position of placement of the recording material P on the belt is continuously shifted, whereas the first and second exemplary embodiments shift position of placement of the recording material P on the belt in an intermittent manner. The image forming unit is the same as that in the first exemplary embodiment, and the description thereof is not repeated here.

Figure 26:
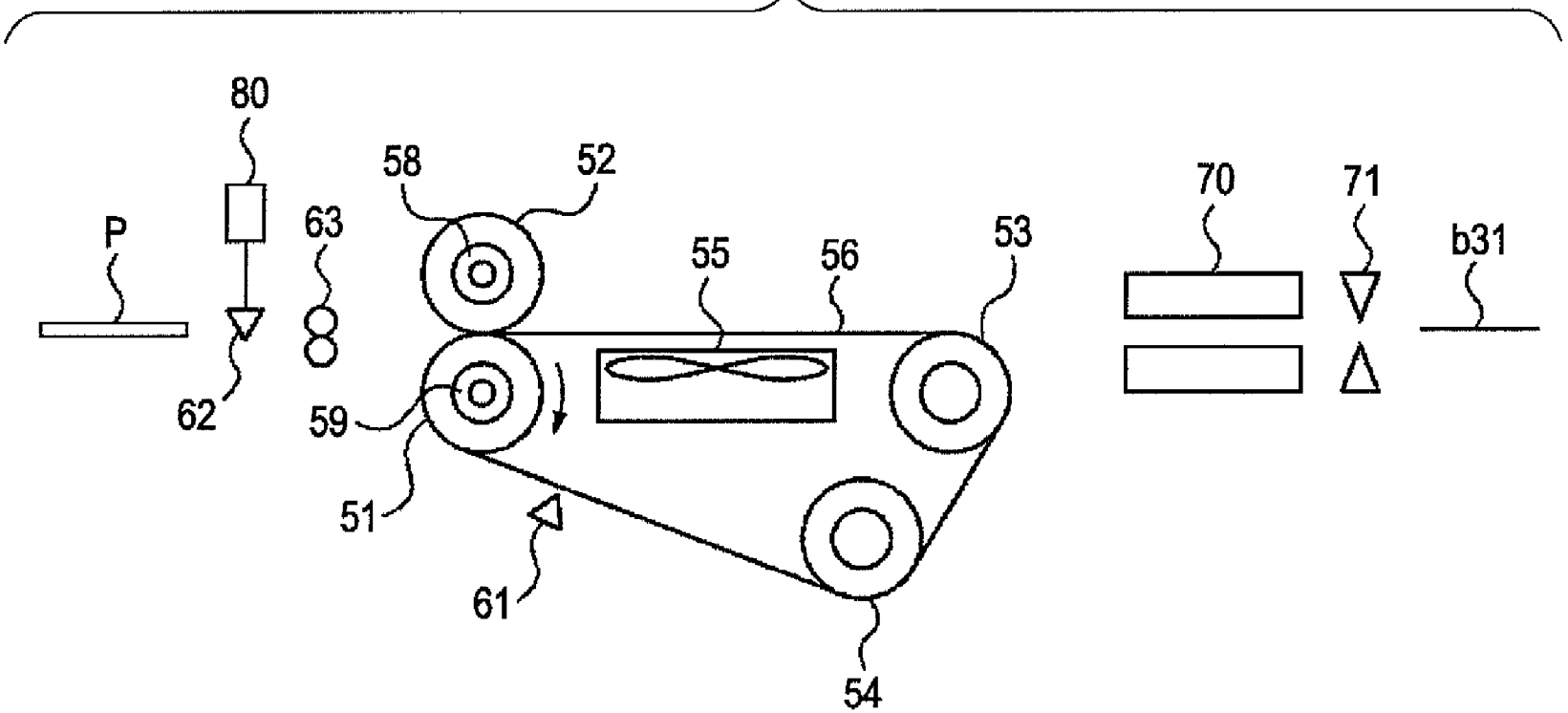
FIG. 26 is a schematic cross-sectional view of an image heating apparatus according to a third exemplary embodiment.

FIG. 26 illustrates the structure according to this exemplary embodiment. The fundamental structure, such as rollers, the cooling region, cutters, and recording materials, is substantially the same as that in the first exemplary embodiment.

An exemplary control according to this exemplary embodiment is described below.

A recording material P (1) is output from the image forming unit A and passes through the recording-material detection sensor 62 via the conveyance member 46. The leading edge of the recording material P (1) is sandwiched between the resist rollers 63, and the recording material P (1) is stopped temporarily (S31 and S801-S803 in FIG. 30). At this time, the belt 56 continues rotating.

The reference position of the belt 56 is detected by the reference-position detection sensor 61. The resist rollers 63 start rotating again so that the time at which the recording-material placement position HT (1) on the belt 56 reaches the thermal nip portion is in synchronism with the time at which the leading edge of the recording material P (1) reaches the thermal nip portion, thus conveying the recording material P (1) into the thermal nip portion (S804-S806 in FIG. 30).

The recording material P (1) passes through the pressure contact part defined between the belt 56 and the pressure roller 52, and the recording material P (1) being in close contact with the belt 56 is conveyed to the cooling region together with the rotation of the belt 56, as with the case of the normal control operation in the first exemplary embodiment. The recording material P (1) is sufficiently cooled in the cooling region and is then separated from the surface of the belt 56 due to the stiffness of the recording material in the region where the curvature of the belt 56 is changed by the rotation roller 53 (S807 in FIG. 30).

At this time, foreign matter I (1) which is a mixture of minute amounts of resin and paper powder that has peeled off the resin layer Q2 of the recording material P (1) is isolated from the recording material P (1) and attached to the position HT on the belt 56. The belt 56 is moved while the foreign matter I (1) remains attached to the position HT (1).

Figure 30:
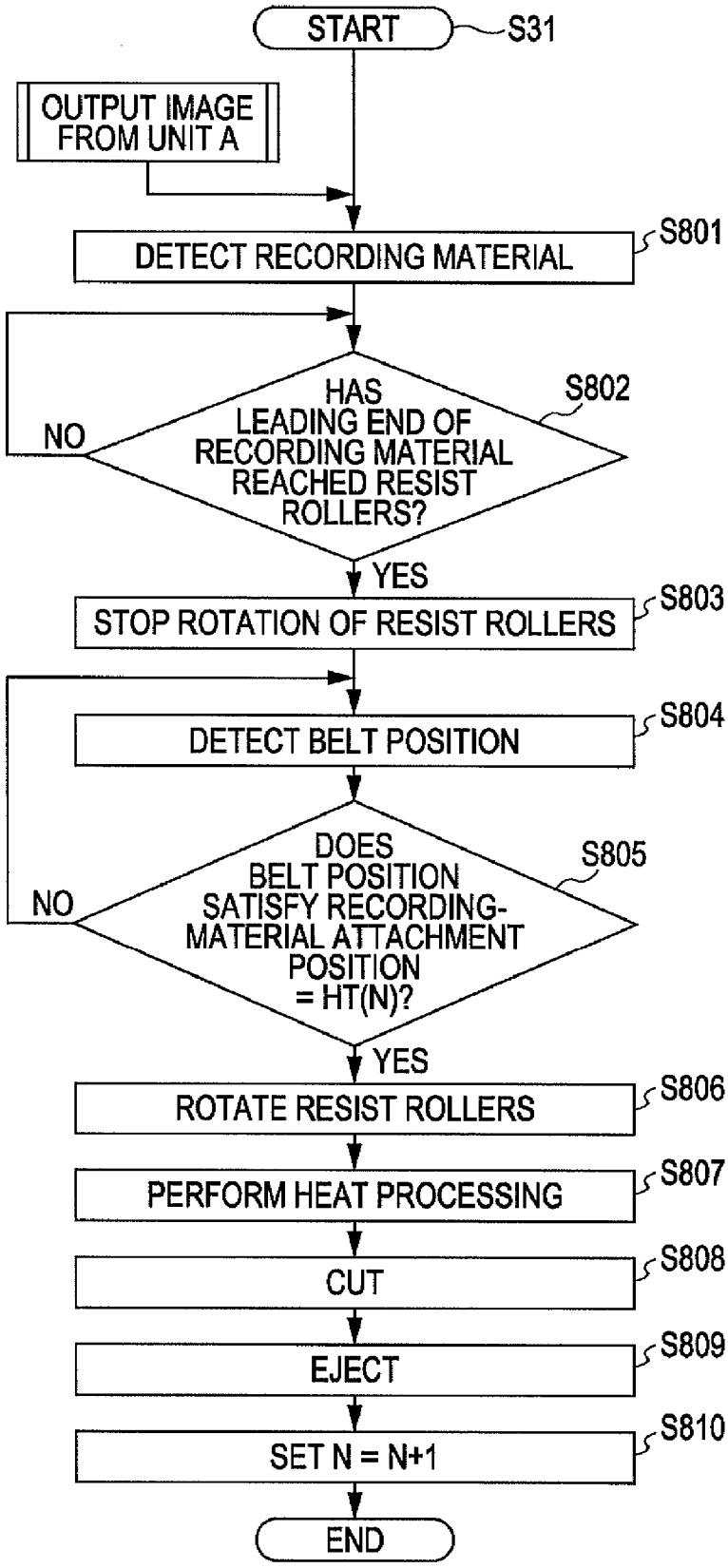
FIG. 30 is a flowchart according to the third exemplary embodiment.

After the separated recording material P(1) passes through the conveyance path (not shown), the top, bottom, right, and left ends of the recording material P (1) are cut by the cutters 70 and 71 with cutting widths WT and WY which are smaller than the margin widths, and the recording material P (1) is ejected onto the output tray b31 (S808-S810 in FIG. 30).

In the next gloss application processing operation, a subsequent recording material P (2) is conveyed by the resist rollers 63 so as to correspond to a recording-material placement position HT (2) (S801-S806 in FIG. 30).

Figure 27:
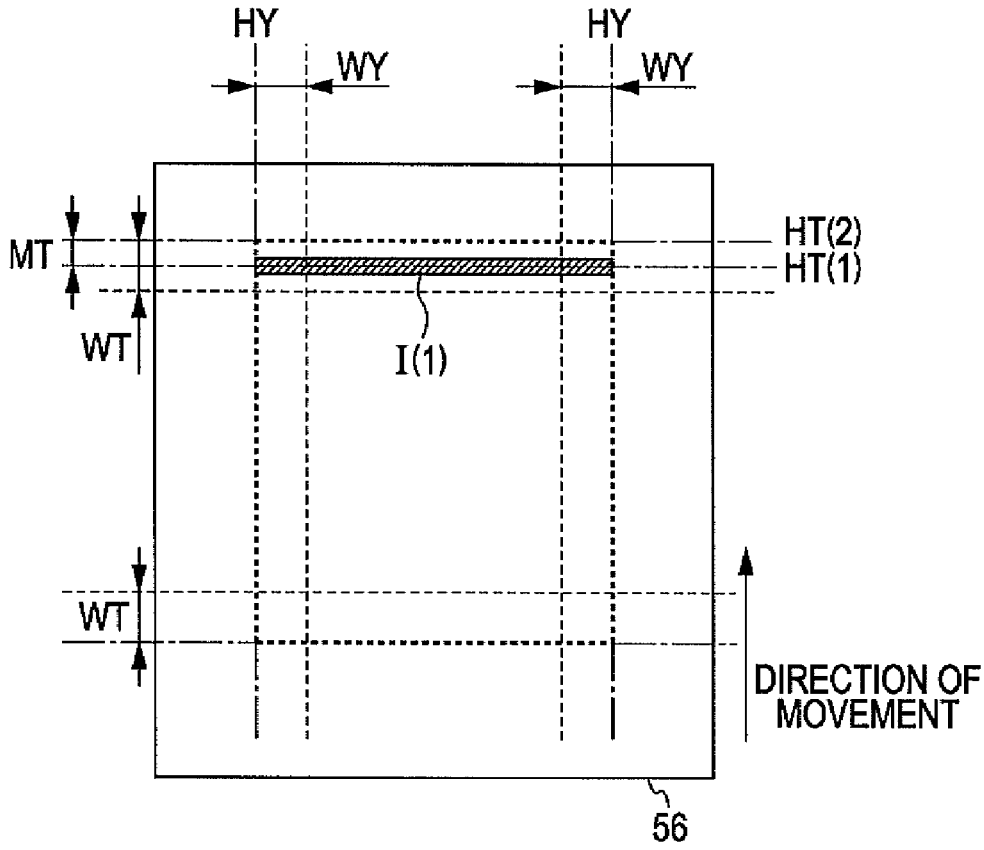
FIG. 27 illustrates a relationship among the belt, the foreign matter attached to the belt, and the cutting width.

As illustrated in FIG. 27, the recording-material placement position HT (2) of the recording material P (2) on the belt 56 is set to be downstream of the recording-material placement position HT (1) of the recording material P (1) in the conveying direction. The cutting width WT, when the leading and trailing ends of the recording material are cut, is set to be larger than the distance MT between the recording-material placement positions HT (2) and HT (1).

Therefore, the foreign matter I (1) attached to the belt 56 is present within the margin area to be cut of the recording material P (2) in the normal gloss application processing operation with respect to the subsequent recording material P (2).

Figure 28:
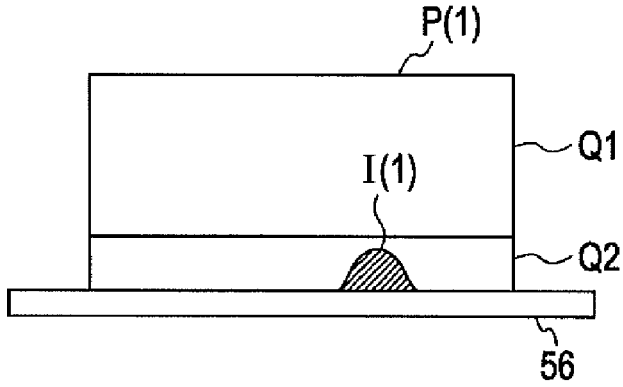
FIG. 28 illustrates a state in which the foreign matter on the belt sinks in a resin layer of a recording material.

In the gloss application processing to the recording material P (2), the foreign matter I (1) attached to the belt 56 and the recording material P (2) pass through the pressure contact part formed between the belt 56 and the pressure roller 52. During this process, since heat from the driving roller 51 and the pressure roller 52 is applied to the recording material P (2) and the foreign matter I (1) on the recording material P (2), the temperature of the transparent resin layer Q2 in the recording material P (2) raises and the resin layer Q2 softens. In addition, pressure produced by the driving roller 51 and the pressure roller 52 is applied to the recording material P (2) and the foreign matter I (1) thereon. As a result, as illustrated in FIG. 28, the foreign matter I (1) sinks in the high-temperature transparent resin layer Q2 in the recording material P (2). At the same time, the recording material P (2) comes into close contact with the surface of the belt 56.

Then, the recording material P (2) is conveyed to the cooling region, is sufficiently cooled, is separated from the surface of the belt 56 due to the stiffness of the recording material in the region where the curvature of the belt 56 is changed by the rotation roller 53 (S807-S810 in FIG. 30), as with the case of the gloss application processing operation with respect to the previous recording material P (1).

At this time, since the foreign matter I (1) that was attached to the recording-material placement position HT (1) on the belt 56 sinks in the recording material P (2), the foreign matter I (1) is isolated from the surface of the belt 56 together with the recording material P (2). Therefore, no foreign matter remains on the recording-material placement position HT (1). The belt 56 is moved while foreign matter I (2), which is a mixture of minute amounts of resin and paper powder that has peeled off the resin layer Q2 of the recording material P (2), remains attached on the recording-material placement position HT (2) on the belt 56.

In the next further gloss application processing operation (S801-S810 in FIG. 30), a subsequent recording material P (3) is conveyed by the resist rollers 63 so as to correspond to a recording-material placement position HT (3).

Figure 29:
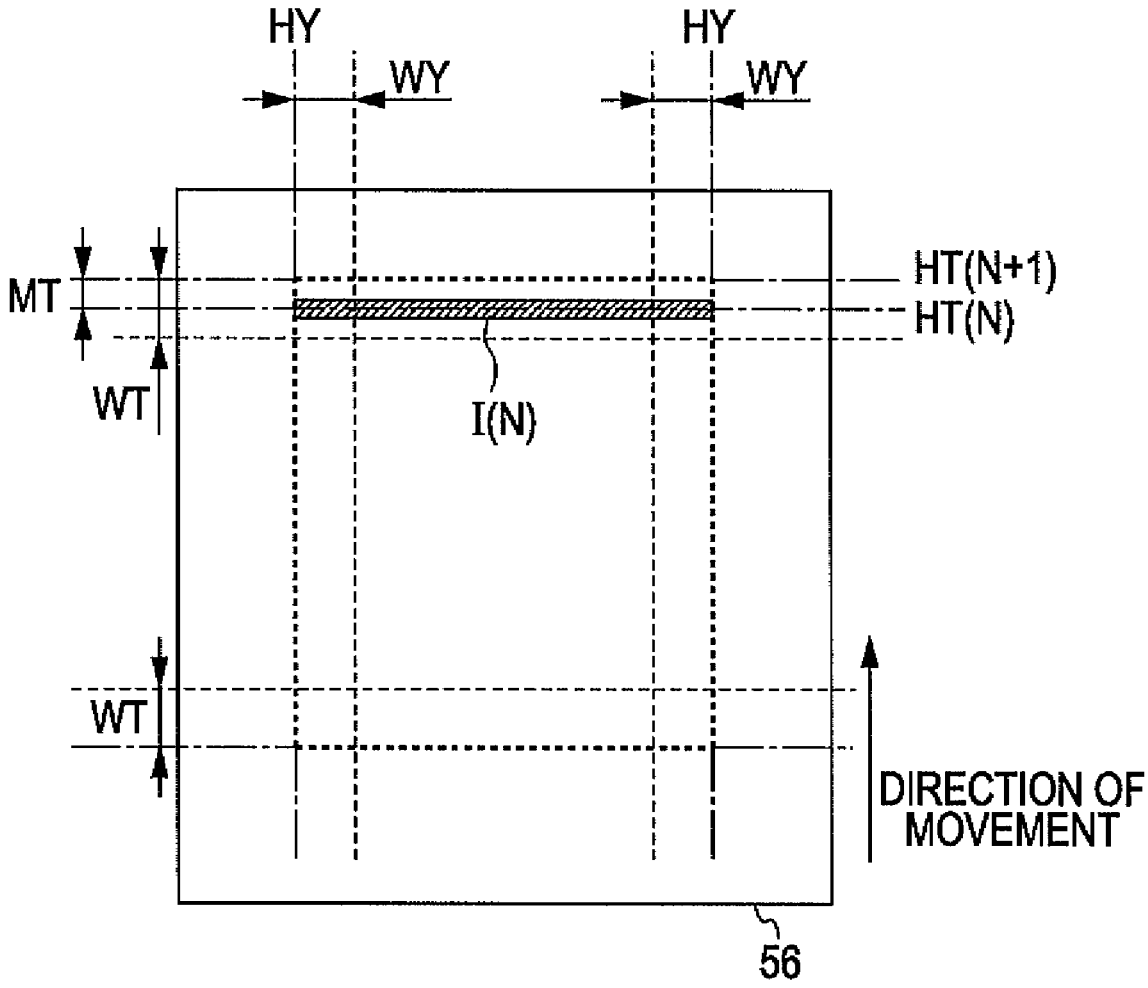
FIG. 29 illustrates a relationship among the belt, the foreign matter attached to the belt, and the cutting width.

As illustrated in FIG. 29, the timing of conveying the recording material P (N) is continuously shifted by a fixed period of time with respect to the timing of conveying the previous recording material P (N−1), thereby setting the position HT (N) of placement of the recording material P (N) on the belt 56 so as to be continuously shifted by a fixed amount (in this exemplary embodiment, MT) downstream of the position HT (N−1) of placement of the previous recording material P (N−1) in the conveying direction, and the gloss application processing operation is repeated.

In other words, the amount of foreign matter attached on the belt 56 is only the amount of foreign matter that dropped from the recording material used in the last gloss application processing operation. Therefore, even when the gloss application processing operation is repeated over a long period of time, the amount of foreign matter attached to and accumulated on the belt 56 can be significantly reduced. As a result, a decrease in the separability of a recording material from the conveyance separation portion on the belt 56 can be suppressed, and the amount of accumulated foreign matter, which may damage the belt 56, can be reduced. The durability of the belt 56 can be secured over a long period of time. The flowchart of the above-described control processing according to this exemplary embodiment is illustrated in FIG. 30.

In this exemplary embodiment, the position HT (N) of placement of the recording material P (N) is continuously shifted by a fixed amount so as to be located downstream of the previous position HT (N−1) of placement of the recording material P (N−1) in the conveying direction. Alternatively, continuously shifting the position HT (N) by a fixed amount so as to be located downstream of the previous position HT (N−1) can offer the similar advantages because the amount of foreign matter attached to and accumulated on the belt 56 is constant. However, in terms of minimization of the amount of accumulated foreign matter on the belt 56, shifting the position downstream in the conveying direction, as in this exemplary embodiment, is useful.

Fourth Exemplary Embodiment

Figure 31:
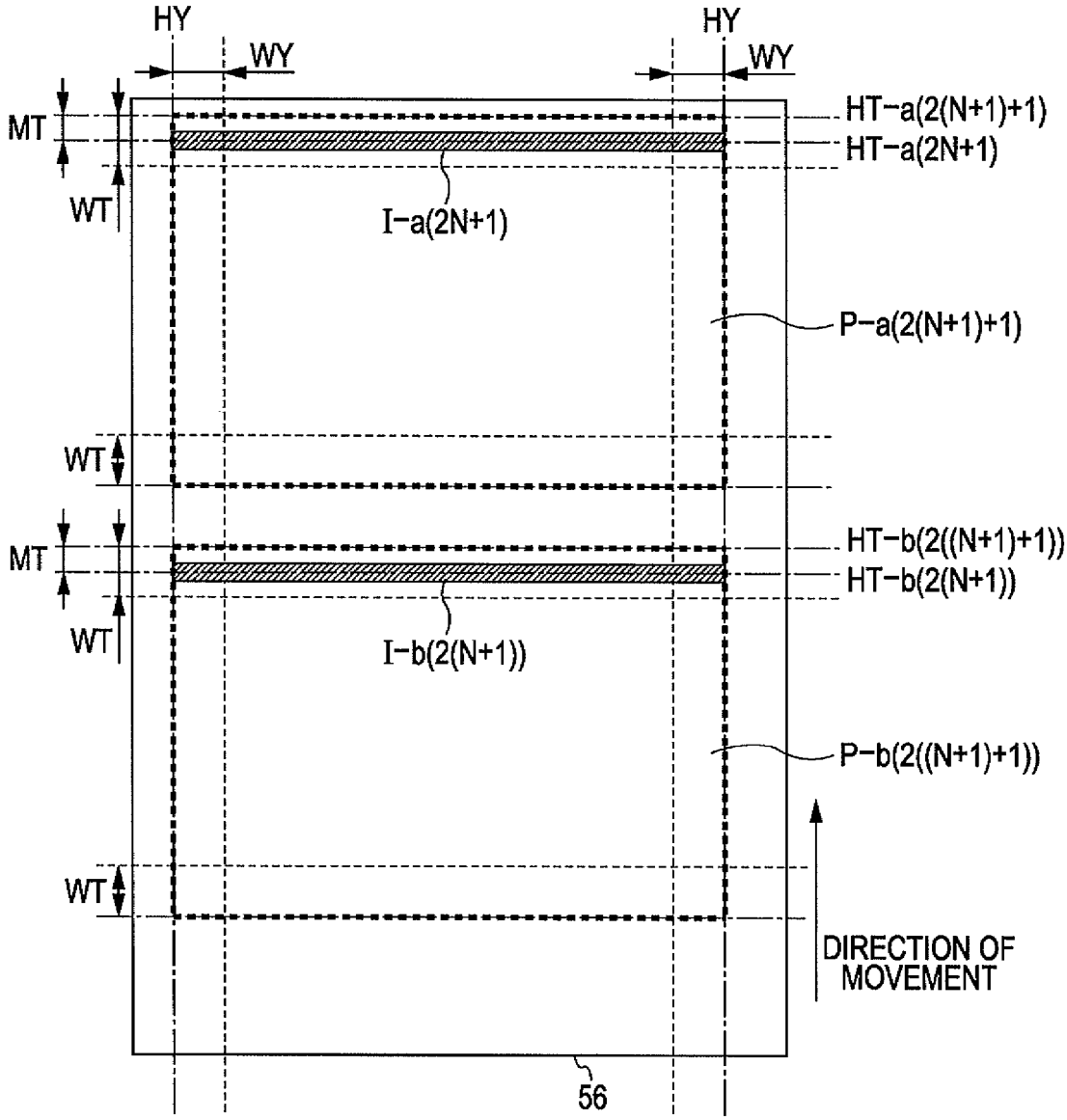
FIG. 31 illustrates a relationship among the belt, the foreign matter attached to the belt, and the cutting width.

In this exemplary embodiment, as illustrated in FIG. 31, a plurality of recording-material placement positions on the belt 56 are provided, and a plurality of recording materials are placed on the belt 56 within a single peripheral surface thereof. The other structure is substantially the same as that of the first exemplary embodiment, and the description thereof is not repeated here.

An exemplary control according to this exemplary embodiment is described below.

Figure 32A:
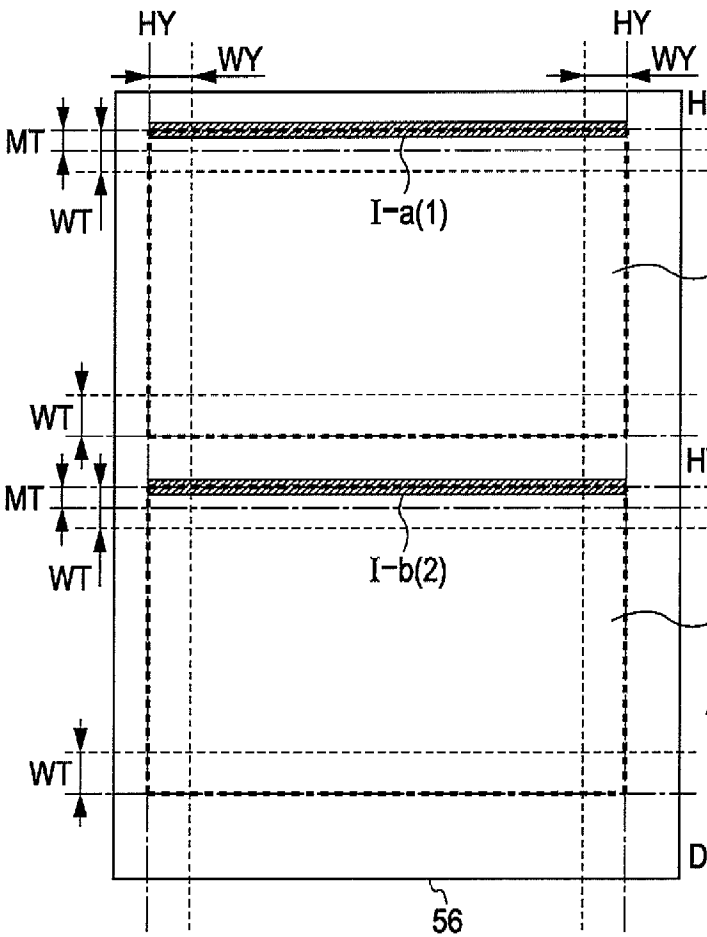
FIGS. 32A and 32B illustrate relationships among the belt, the foreign matter attached to the belt, and the cutting width.

After a recording material P-a (1) is output from the image forming unit A, the operation substantially the same as in the third exemplary embodiment is performed. During this operation, the recording material P-a (1) is set so as to be placed on a recording-material placement position HT-a (1) on the belt 56, as illustrated in FIG. 32A.

A recording material P-b (2) used in the next image output is subjected to the same gloss application processing operation after being output from the image forming unit A, as with the case of the recording material P-a (1). During this process, the recording material P-b (2) is set so as to be placed on a recording-material placement position HT-b (2) on the belt 56, as illustrated in FIG. 32A.

In other words, when a plurality of image outputs are performed, a plurality of recording-material placement positions are set so that a plurality of recording materials are placed on the belt 56 within a single peripheral surface thereof.

Figure 33:
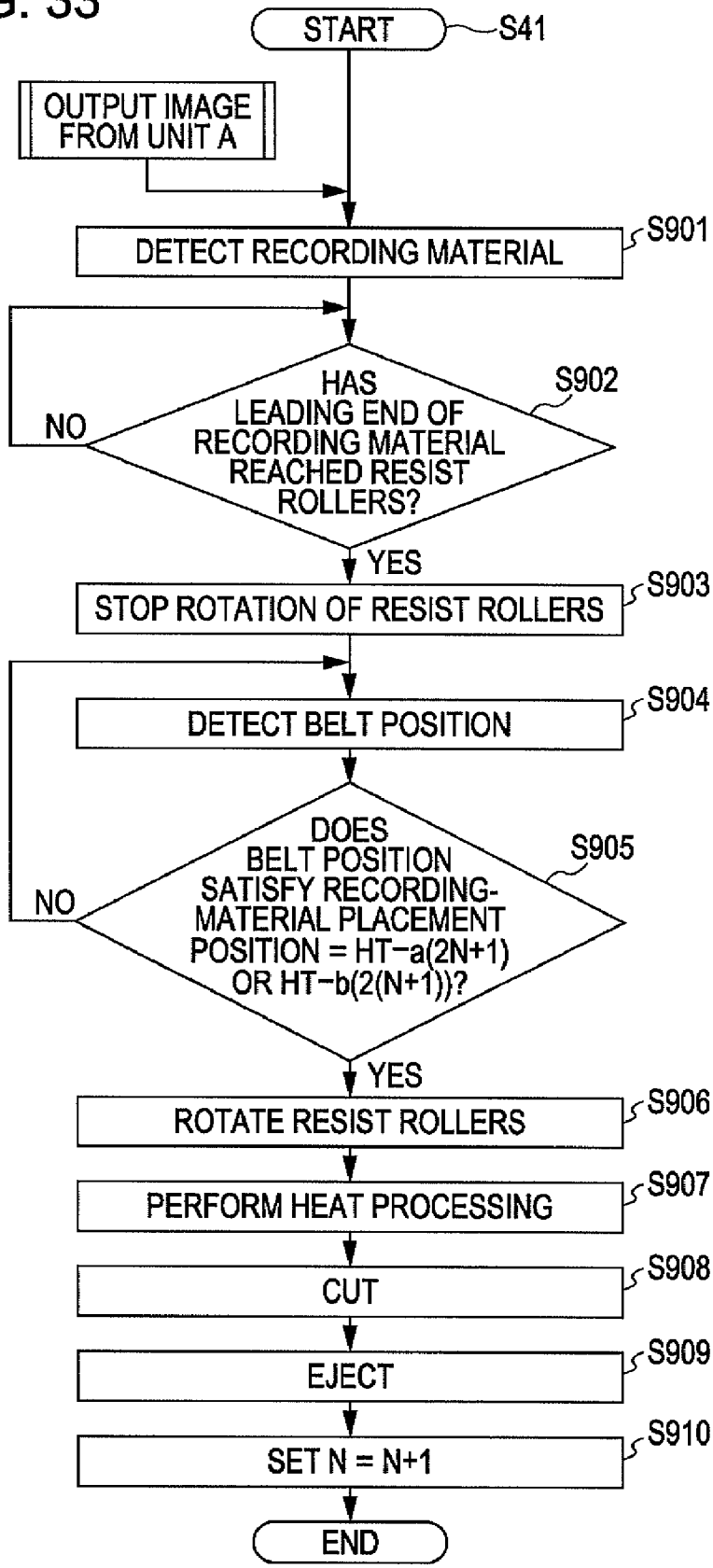
FIG. 33 is a flowchart according to a fourth exemplary embodiment.

Each of the recording materials P-a (1) and P-b (2) is conveyed into the thermal nip portion, as in the third exemplary embodiment, subjected to the same gloss application processing operation, and separated from the surface of the belt 56 due to the stiffness of the recording material in the region where the curvature of the belt 56 is changed by the rotation roller 53 (S41 and S901-S907 in FIG. 33).

After the separated recording materials P-a (1) and P-b (2) pass through the conveyance path (not shown), the top, bottom, right, and left ends of each of the recording materials P-a (1) and P-b (2) are cut by the cutters 70 and 71 with cutting widths WT and WY which are smaller than the margin widths, and the recording materials P-a (1) and P-b (2) are ejected onto the output tray b31 (S908-S910 in FIG. 33).

When the recording materials P-a (1) and P-b (2) are separated from the belt 56, as in the third exemplary embodiment, foreign matter I-a (1) that dropped from the recording material P-a (1) and foreign matter I-b (2) that dropped from the recording material P-b (2) are attached to the positions HT-a (1) and HT-b (2), respectively, and the belt 56 are moved while the foreign matters I-a(1) and I-b (2) remain attached.

In the next gloss application processing operation, subsequent recording materials P-a (3) and P-b (4) are conveyed by the resist rollers 63 so as to correspond to recording-material placement positions HT-a (3) and HT-b (4), respectively (S901-S910 in FIG. 33).

Figure 32B:
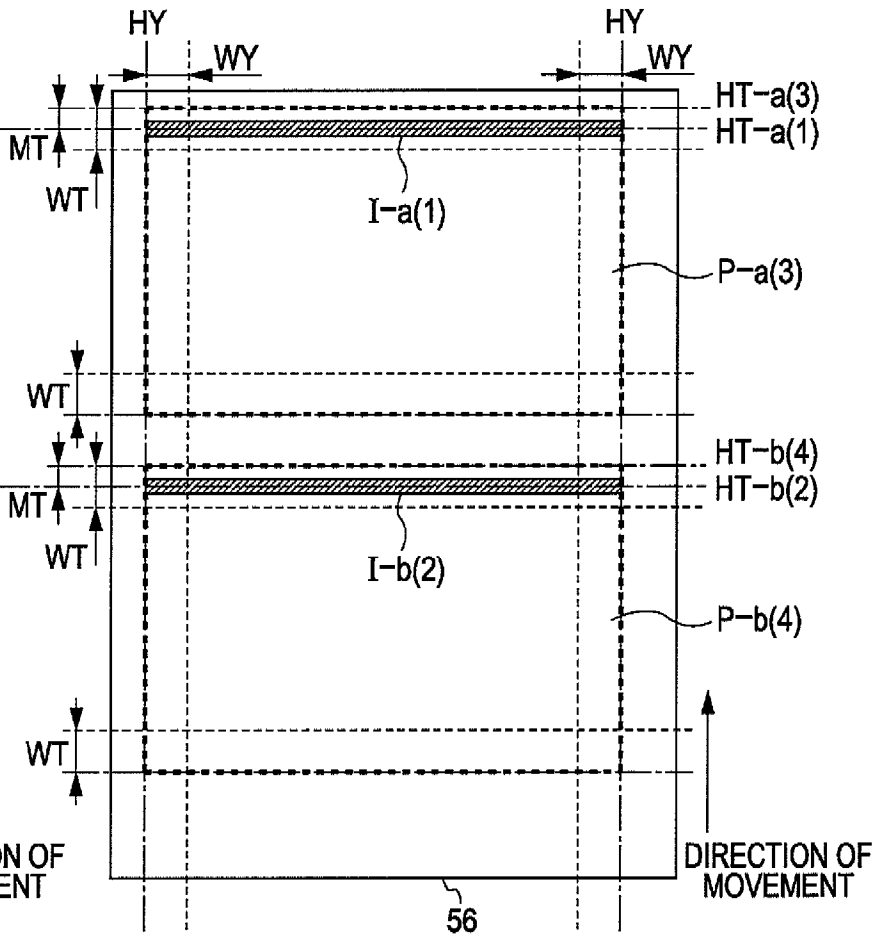

As illustrated in FIG. 32B, the recording-material placement position HT-a (3) of the recording material P-a (3) is set to be downstream of the recording-material placement position HT-a (1) of the recording material P-a (1) in the conveying direction. Similarly, as illustrated in FIG. 32B, the recording-material placement position HT-b (4) of the recording material P-b (4) is set to be downstream of the recording-material placement position HT-b (2) of the recording material P-b (2) in the conveying direction.

The cutting width WT, when the leading and trailing ends of the recording material are cut, is set to be larger than the distance MT between the recording-material placement positions HT-a (3) and HT-a (1) and between the recording-material placement positions HT-b (4) and HT-b (2).

The foreign matter I-a (1) attached to the position HT-a (1) and the foreign matter I-b (2) attached to the position HT-b (2) are present within the margin areas to be cut of the recording materials P-a (3) and P-b (4) in the gloss application processing operation with respect to the subsequent recording materials P-a (3) and P-b (4), as in the third exemplary embodiment.

Through the gloss application processing operation described above, as in the third exemplary embodiment, the foreign matter I-a (1) that was attached to the recording-material placement position HT-a (1) on the belt 56 and the foreign matter I-b (2) that was attached to the recording-material placement position HT-b (2) on the belt 56 sink in the recording material P-a (3) and the recording material P-b(4), respectively. Therefore, the foreign matters I-a (1) and I-b (2) are isolated from the surface of the belt 56 together with the recording materials P-a (3) and P-b (4). Therefore, no foreign matter remains on the recording-material placement positions HT-a (1) and HT-b (2). The belt 56 is moved while foreign matters I-a (3) and I-b (4), which are a mixture of minute amounts of resin and paper powder that has peeled off the resin layer Q2 of each of the recording materials P-a (3) and P-b (4), remain attached on the positions HT-a (3) and HT-b (4), respectively.

In the next gloss application processing operation, subsequent recording materials P-a (5) and P-b (6) are conveyed by the resist rollers 63 so as to correspond to recording-material placement positions HT-a (5) and HT-b (6), respectively (S901-S910 in FIG. 33).

As illustrated in FIG. 31, control is performed in which the timing of conveying the recording materials P-a (2(N+1)+1) and P-b (2((N+1)+1)) are continuously shifted by a fixed period of time with respect to the timing of conveying the previous recording materials P-a(2N+1) and P-b (2(N+1)), respectively. This control enables the position HT-a (2(N+1)+1) of placement of the recording material P-a (2(N+1)+1) on the belt 56 and the position HT-b (2((N+1)+1)) of placement of the recording material P-b (2((N+1)+1)) on the belt 56 to be continuously shifted by a fixed amount downstream of the position HT-a (2N+1) of placement of the previous recording material P-a (2N+1) and the position HT-b (2(N+1)) of placement of the recording material P-b (2(N+1)) in the conveying direction.

In other words, when the control according to this exemplary embodiment is performed, the amount of foreign matter attached on the belt 56 is only the amount of foreign matter that dropped from the recording material used in the last gloss application processing operation. Therefore, even when the gloss application processing operation is repeated over a long period of time, the amount of foreign matter attached to and accumulated on the belt 56 can be significantly reduced. As a result, a decrease in the separability of a recording material from the conveyance separation portion on the belt 56 can be suppressed, and the amount of accumulated foreign matter, which may damage the belt 56, can be reduced. The durability of the belt 56 can be secured over a long period of time.

The relationship between the recording-material placement positions HT-a (2N+1) and HT-b (2(N+1)) on the belt 56 is described.

FIG. 31 is a developed view of the belt 56. As illustrated in FIG. 31, the recording-material placement position HT-a (2(N+1)+1) and HT-b (2((N+1)+1)) are set so that both positions do not overlap each other when the recording materials are placed.

Therefore, the foreign matter I-a (2N+1) attached to the position HT-a (2N+1) and the foreign matter I-b (2(N+1)) attached to the position HT-b (2(N+1)) are not present within the image areas of the recording material P-a (2(N+1)+1) and the recording material P-b (2((N+1)+1)). As a result, image defects resulting from the foreign matter I-a (2N+1) and the foreign matter I-b (2(N+1)) do not occur.

Figure 34:
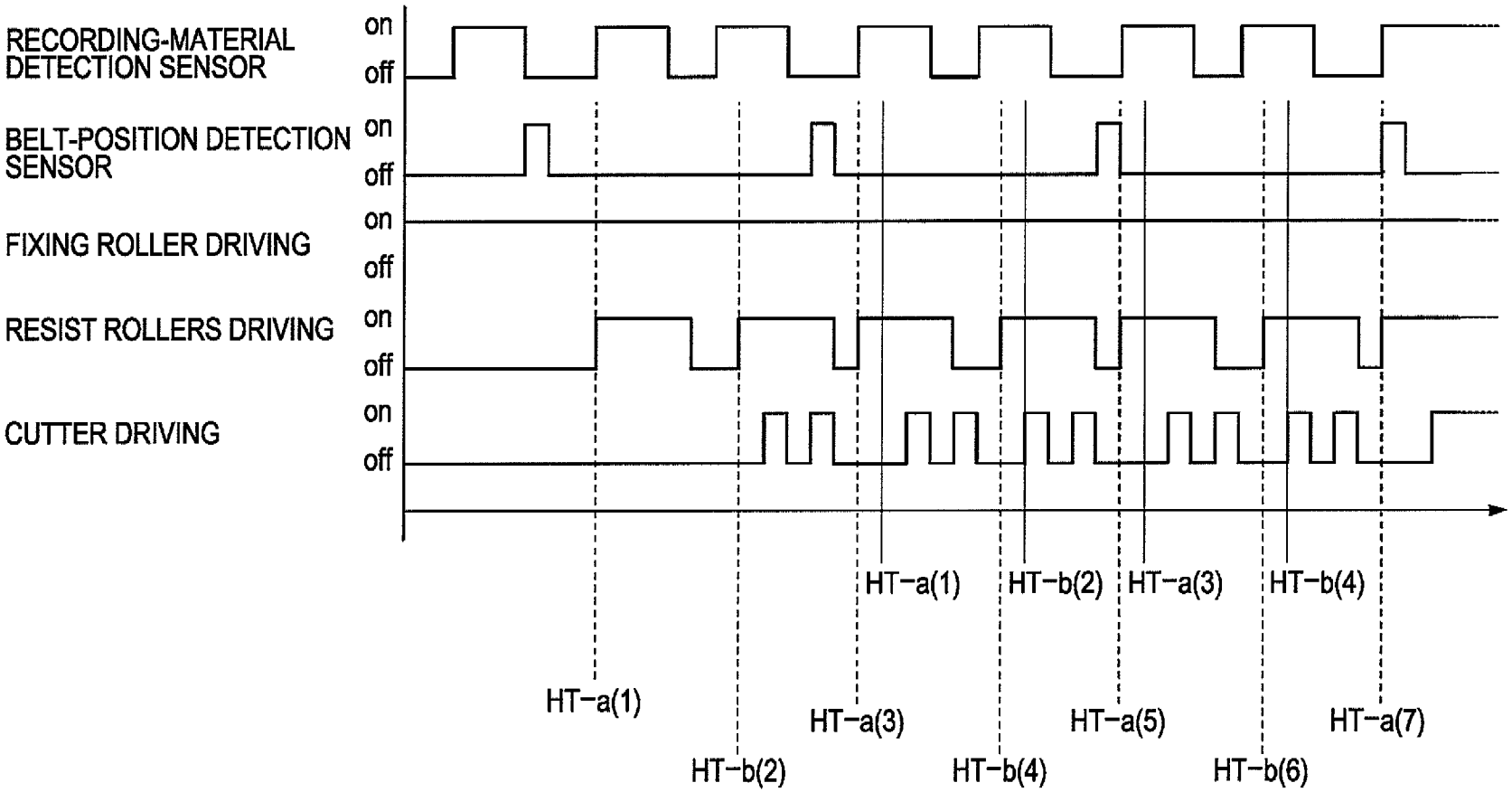
FIG. 34 is a timing diagram according to the fourth exemplary embodiment.

When image output is repeated using the settings of this exemplary embodiment in which a plurality of recording-material placement positions are provided on the single belt 56 and a plurality of recording materials are placed on the belt 56 within a single peripheral surface thereof, image defects resulting from foreign matter such as powder and a resin component dropping from the previous recording materials into the image areas of the recording materials do not occur. Furthermore, productivity in image output can be improved. The flowchart of the control processing described above is illustrated in FIG. 33. The timing diagram according to this exemplary embodiment is illustrated in FIG. 34.

As described above, a plurality of recording materials is placed on a single periphery of the belt, and the timing of conveying each of the recording materials is shifted by using the resist rollers, and therefore, the recording materials are placed so that the recording-material placement position of each of the recording materials is shifted by a fixed amount downstream in the conveying direction.

In this exemplary embodiment, the number of recording materials placed on a single periphery of the belt is two. However, the number is not limited to two. The number can be three or more.

As described in the first to fourth exemplary embodiments, control of shifting the recording-material placement position on the belt can be performed continuously with respect to each of the position of the recording material relating to the leading end on the belt and the positions of placement of the recording material relating to the left and right ends on the belt and can be intermittently at any time. However, the present invention is not limited to the combinations described in the exemplary embodiments. Freely controlling each of the positions of leading ends and the right and left ends of the recording material can be combined. This case can offer the similar advantages.

Further, in the first to fourth exemplary embodiments, the position of placement of the recording material on the belt in the direction parallel to the conveying direction is changed by detection of the position on the belt with the sensor and change of the timing of conveyance with the resist rollers in accordance with the detection. However, other methods can offer the similar advantages. For example, the recording-material placement position on the belt can be adjusted by stopping the rotation of the belt without the use of the resist rollers. In other words, controlling at least one of the driving of the belt and the conveyance of the recording material is sufficient.

In the first to fourth exemplary embodiments, the image forming device including the image heating apparatus (gloss processing unit) is described. However, the present invention is applicable to a discrete single image heating apparatus, which is not incorporated in the image forming device. In the exemplary embodiments, the fuser 40 is disposed in the image forming unit A. However, the present invention is applicable to an image forming device that incorporates an image heating apparatus, in place of the fuser 40.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2005-265516 filed Sep. 13, 2005, which is hereby incorporated by reference herein in its entirety.

What is claimed is:

1. An image heating apparatus operable to heat a toner image formed on a recording material, comprising:

an endless belt capable of being in contact with a surface of the recording material, the surface carrying the toner image;

a heating member configured to heat the recording material;

a cooling member configured to cool the recording material;

a controller configured to control relative positions of an outer peripheral surface of the belt and the recording material, the controller causing a subsequent recording material to be in close contact with an area substantially the same as an area in close contact with a previous recording material on the belt, wherein the recording material carrying the toner image is heated by the heating member and cooled by the cooling member while being moved together with rotation of the belt with the surface carrying the toner image of the recording material being in close contact with the belt, and the recording material is then separated from the belt, wherein the controller controls at least one of driving of the belt and conveyance of the recording material so that a position on the belt in contact with a leading edge of the subsequent recording material is shifted downstream of a position on the belt in contact with a leading edge of the previous recording material in a rotation direction of the belt at a predetermined timing; and a cutting unit configured to cut at least the leading edge of the recording material separated from the belt, wherein an amount of shifting the leading edge of the recording material in the shifting control (MT) is equal to or smaller than an amount of cutting performed by the cutting unit (WT).

2. The image heating apparatus according to claim 1, wherein the controller performs the shifting control of the leading edge of the subsequent recording material after a predetermined number of recording materials are processed so that the position in contact with the leading edge of the previous recording material and the position in contact with the leading edge of the subsequent recording material overlap each other.

3. The image heating apparatus according to claim 1, wherein the controller performs the shifting control each time when the recording material is processed.

4. The image heating apparatus according to claim 1, further comprising a mechanism configured to change the relative positions of the belt and the recording material in a direction orthogonal to the rotational direction of the belt, wherein the controller shifts the relative positions in the direction orthogonal to the rotation direction in the shifting control when performing the shifting control.

* * * * *